US009103507B2

(12) United States Patent
Allen et al.

(10) Patent No.: US 9,103,507 B2
(45) Date of Patent: Aug. 11, 2015

(54) LED LAMP WITH UNIFORM OMNIDIRECTIONAL LIGHT INTENSITY OUTPUT

(75) Inventors: Gary R. Allen, Chesterland, OH (US); David C. Dudik, South Euclid, OH (US); Boris Kolodin, Beachwood, OH (US); Joshua I. Rintamaki, Westlake, OH (US); Bruce R. Roberts, Mentor-on-the-Lake, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 619 days.

(21) Appl. No.: 12/572,339

(22) Filed: Oct. 2, 2009

(65) Prior Publication Data

US 2011/0080740 A1 Apr. 7, 2011

(51) Int. Cl.
*F21V 11/00* (2006.01)
*F21V 3/00* (2006.01)
(Continued)

(52) U.S. Cl.
CPC ..... *F21K 9/1355* (2013.01); *F21K 9/135* (2013.01); *F21K 9/56* (2013.01); *F21V 3/00* (2013.01); *F21V 9/00* (2013.01); *F21V 29/02* (2013.01); *F21V 29/507* (2015.01); *F21V 29/677* (2015.01); *F21V 29/74* (2015.01); *F21V 29/77* (2015.01); *F21V 29/006* (2013.01); *F21Y 2101/02* (2013.01); *F21Y 2103/022* (2013.01); *F21Y 2113/005* (2013.01)

(58) Field of Classification Search
CPC ..... F21V 3/02; F21V 5/041
USPC ..... 362/640, 558, 249.02, 246, 311.02, 362/311.06, 355
See application file for complete search history.

(56) References Cited

U.S. PATENT DOCUMENTS 5,899,557 A * 5/1999 McDermott ..... 362/244
6,227,679 B1 5/2001 Zhang et al.
(Continued)

FOREIGN PATENT DOCUMENTS

DE 10 2007 037820 2/2009
GB 2366610 3/2002
(Continued)

OTHER PUBLICATIONS

US Department of Energy, "Bright Tomorrow Lighting Competition," Revision 1, at http://www.lightingprize.org/pdfs/LPrize-Revision1.pdf, Jun. 26, 2009.
(Continued)

*Primary Examiner* — Jong-Suk (James) Lee
*Assistant Examiner* — Bryon T Gyllstrom
(74) *Attorney, Agent, or Firm* — Fay Sharpe LLP

(57) ABSTRACT

A light emitting apparatus comprises: an LED-based light source; a spherical, spheroidal, or toroidal diffuser generating a Lambertian light intensity distribution output at any point on the diffuser surface responsive to illumination inside the diffuser; and a base including a base connector. The LED based light source, the diffuser, and the base are secured together as a unitary LED lamp installable in a lighting socket by connecting the base connector with the lighting socket. The diffuser is shaped and arranged respective to the LED based light source in the unitary LED lamp to conform with an isolux surface of the LED based light source. The base is operatively connected with the LED based light source in the unitary LED lamp to electrically power the LED based light source using electrical power received at the base connector.

36 Claims, 14 Drawing Sheets

(51) Int. Cl.

| | |
|---|---|
| ***F21V 5/00*** | (2006.01) |
| ***F21S 4/00*** | (2006.01) |
| ***F21V 21/00*** | (2006.01) |
| ***F21K 99/00*** | (2010.01) |
| ***F21V 9/00*** | (2015.01) |
| ***F21V 29/02*** | (2006.01) |
| ***F21V 29/507*** | (2015.01) |
| ***F21V 29/67*** | (2015.01) |
| ***F21V 29/74*** | (2015.01) |
| ***F21V 29/77*** | (2015.01) |
| *F21Y 101/02* | (2006.01) |
| *F21V 29/00* | (2015.01) |
| *F21Y 103/02* | (2006.01) |
| *F21Y 113/00* | (2006.01) |

(56) References Cited

U.S. PATENT DOCUMENTS

| | | | | |
|---|---|---|---|---|
| 6,305,821 | B1 * | 10/2001 | Hsieh et al. | 362/246 |
| 6,709,132 | B2 * | 3/2004 | Ishibashi | 362/235 |
| 6,719,446 | B2 * | 4/2004 | Cao | 362/547 |
| 6,746,885 | B2 * | 6/2004 | Cao | 438/26 |
| 7,086,756 | B2 | 8/2006 | Maxik | |
| D538,950 | S | 3/2007 | Maxik | |
| D538,951 | S | 3/2007 | Maxik | |
| 7,273,300 | B2 * | 9/2007 | Mrakovich | 362/249.01 |
| 7,314,291 | B2 * | 1/2008 | Tain et al. | 362/294 |
| 7,413,325 | B2 * | 8/2008 | Chen | 362/249.01 |
| 2004/0228131 | A1 * | 11/2004 | Minano et al. | 362/307 |
| 2005/0116597 | A1 | 6/2005 | Hsu | |
| 2005/0127543 | A1 | 6/2005 | Ricking et al. | |
| 2005/0174769 | A1 | 8/2005 | Yong et al. | |
| 2006/0005947 | A1 | 1/2006 | Arik et al. | |
| 2006/0034077 | A1 * | 2/2006 | Chang | 362/227 |
| 2006/0092640 | A1 | 5/2006 | Li | |
| 2006/0187653 | A1 * | 8/2006 | Olsson | 362/111 |
| 2006/0215422 | A1 | 9/2006 | Laizure et al. | |
| 2007/0189010 | A1 * | 8/2007 | Arai | 362/257 |
| 2007/0236912 | A1 | 10/2007 | Porchia et al. | |
| 2007/0267976 | A1 | 11/2007 | Bohler et al. | |
| 2008/0062703 | A1 * | 3/2008 | Cao | 362/311 |
| 2008/0080166 | A1 | 4/2008 | Duong | |
| 2008/0123349 | A1 * | 5/2008 | Chaves et al. | 362/329 |
| 2008/0278955 | A1 | 11/2008 | Boyer | |
| 2009/0059591 | A1 * | 3/2009 | Nakamura et al. | 362/259 |
| 2009/0129102 | A1 | 5/2009 | Xiao et al. | |
| 2009/0135595 | A1 | 5/2009 | Chen | |
| 2009/0174302 | A1 * | 7/2009 | Davey et al. | 313/11 |
| 2009/0195186 | A1 | 8/2009 | Guest et al. | |
| 2010/0195335 | A1 * | 8/2010 | Allen et al. | 362/309 |

FOREIGN PATENT DOCUMENTS

| | | | |
|---|---|---|---|
| JP | 2004-186109 | A2 | 7/2004 |
| WO | WO 2007/130357 | | 11/2007 |
| WO | 2009089529 | A1 | 7/2009 |
| WO | WO 2009/128004 | | 10/2009 |

OTHER PUBLICATIONS

US Department of Energy, "Energy Star Program Requirements for Integral LED Lamps," Draft 2, at www.energystar.gov/.../integral_leds/Draft_2_ENERGY_STAR_LED_Integral_Lamp_Specification.pdf., May 19, 2009.

US Department of Energy, "Energy Star Program Requirements for Integral LED Lamps, Eligibility Criteria," Third Draft, Sep. 18, 2009.

CAO Group, Inc., "Dynasty Light Redefined," Onesolution, at http://www.caogroup.com/(S(Ib510f45dojgv045obhfxguh))/PDF/OPTO/Dynasty_S14_Brochure.pdf, Sep. 25, 2008.

OSRAM, "OSRAM LEDs: give your home a bright new look.", at http://www.olafsson.is/resources/Files/Olafsson_is/OSRAM-pdf/led_baeklingur.pdf, last visited Dec. 16, 2009.

International Search Report from PCT/US2010/051043.

EP10821324 Supplemental Search Report.

Unofficial English translation of CN Office Action dated Aug. 21, 2013 from corresponding CN Application No. 201080054756.4

* cited by examiner

LED LAMP WITH UNIFORM OMNIDIRECTIONAL LIGHT INTENSITY OUTPUT

BACKGROUND

The following relates to the illumination arts, lighting arts, solid-state lighting arts, and related arts.

Integral incandescent and halogen lamps are designed as direct "plug-in" components that mate with a lamp socket via a threaded Edison base connector (sometimes referred to as an "Edison base" in the context of an incandescent light bulb), a bayonet-type base connector (i.e., bayonet base in the case of an incandescent light bulb), or other standard base connector to receive standard electrical power (e.g., 110 volts a.c., 60 Hz in the United States, or 220V a.c., 50 Hz in Europe, or 12 or 24 or other d.c. voltage). The integral lamp is constructed as a unitary package including any components needed to operate from the standard electrical power received at the base connector. In the case of integral incandescent and halogen lamps, these components are minimal, as the incandescent filament is typically operable using the standard 110V or 220V a.c., or 12V d.c., power, and the incandescent filament operates at high temperature and efficiently radiates excess heat into the ambient. In such lamps, the base of the lamp is simply the base connector, e.g. the Edison base in the case of an "A"-type incandescent light bulb.

Some integral incandescent or halogen lamps are constructed as omni-directional light sources which are intended to provide substantially uniform intensity distribution versus angle in the optical far field, greater than 5 or 10 times the linear dimension of the light source, or typically greater than about 1 meter away from the lamp, and find diverse applications such as in desk lamps, table lamps, decorative lamps, chandeliers, ceiling fixtures, and other applications where a uniform distribution of light in all directions is desired.

With reference to FIG. 1, a coordinate system is described which is used herein to describe the spatial distribution of illumination generated by a lamp intended to produce omnidirectional illumination. The coordinate system is of the spherical coordinate system type, and is described in FIG. 1 with reference to a lamp L, which in this illustrated embodiment is an "A"-type incandescent light bulb with an Edison base EB, which may for example be an E25, E26, or E27 lamp base where the numeral denotes the outer diameter of the screw turns on the base EB, in millimeters. For the purpose of describing the far field illumination distribution, the lamp L can be considered to be located at a point L0, which may for example coincide with the location of the incandescent filament. Adopting spherical coordinate notation conventionally employed in the geographic arts, a direction of illumination can be described by an elevation or latitude coordinate $\theta$ and an azimuth or longitude coordinate $\phi$. However, in a deviation from the geographic arts convention, the elevation or latitude coordinate $\theta$ used herein employs a range [0°, 180°] where: $\theta=0°$ corresponds to "geographic north" or "N". This is convenient because it allows illumination along the direction $\theta=0°$ to correspond to forward-directed light. The north direction, that is, the direction from the point L0 through geographic north, $\theta=0°$, is also referred to herein as the optical axis. Using this notation, $\theta=180°$ corresponds to "geographic south" or "S" or, in the illumination context, to backward-directed light. The elevation or latitude $\theta=90°$ corresponds to the "geographic equator" or, in the illumination context, to sideways-directed light.

With continuing reference to FIG. 1, for any given elevation or latitude $\theta$ an azimuth, or longitude coordinate, $\phi$ can also be defined, which is everywhere orthogonal to the elevation or latitude $\theta$. The azimuth or longitude coordinate $\phi$ has a range [0°, 360°], in accordance with geographic notation. At precisely north or south, that is, at $\theta=0°$ or at $\theta=180°$ (in other words, along the optical axis), the azimuth or longitude coordinate has no meaning, or, perhaps more precisely, can be considered degenerate. Another "special" coordinate is $\theta=90°$ which defines the plane transverse to the optical axis which contains the light source (or, more precisely, contains the nominal position of the light source for far field calculations, for example the point L0 in the illustrative example shown in FIG. 1). Achieving uniform light intensity across the entire longitudinal span $\phi=[0°, 360°]$ is typically not difficult, because it is straightforward to construct a light source with rotational symmetry about the optical axis (that is, about the axis $\theta=0°$). For example, the incandescent lamp L suitably employs an incandescent filament located at coordinate center L0 which can be designed to emit substantially omnidirectional light, thus providing a uniform illumination distribution respective to the azimuth $\phi$ for any latitude. A lamp that provides uniform illumination distribution respective to the azimuth $\phi$ for any latitude is sometimes referred to as providing an axially symmetrical light distribution.

However, achieving ideal omnidirectional illumination respective to the elevational or latitude coordinate $\theta$ is generally not practical. For example, the "A" type incandescent light bulb L includes the Edison base EB which lies on the optical axis "behind" the light source position L0, and blocks backward illumination so that the incandescent lamp L does not provide ideal omnidirectional light respective to the latitude coordinate $\theta$ exactly up to $\theta=180°$. Nonetheless, commercial incandescent lamps can provide illumination across the latitude span $\theta=[0°, 135°]$ which is uniform to within about ±20% as specified in the proposed Energy Star standard for Integral LED Lamps ($2^{nd}$ draft, May 9, 2009; hereinafter "proposed Energy Star standard") promulgated by the U.S. Department of Energy. This is generally considered an acceptable illumination distribution uniformity for an omnidirectional lamp, although there is some interest in extending this span still further, such as to a latitude span of $\theta=[0°, 150°]$ with and possibly with a better ±10% uniformity. Such lamps with substantial uniformity over a large latitude range (for example, about $\theta=[0°, 120°]$ or more preferably about $\theta=[0°, 135°]$ or still more preferably about $\theta=[0°, 150°]$) are generally considered in the art to be omnidirectional lamps, even though the range of uniformity is less than [0°, 180°].

There is interest in developing omnidirectional LED replacement lamps that operate as direct "plug-in" replacements for integral incandescent or halogen lamps. However, substantial difficulties have heretofore hindered development of LED replacement lamps with desired omnidirectional intensity characteristics. One issue is that, compared with incandescent and halogen lamps, solid-state lighting technologies such as light emitting diode (LED) devices are highly directional by nature. For example, an LED device, with or without encapsulation, typically emits in a directional Lambertian spatial intensity distribution having intensity that varies with $\cos(\theta)$ in the range $\theta=[0°, 90°]$ and has zero intensity for $\theta>90°$. A semiconductor laser is even more directional by nature, and indeed emits a distribution describable as essentially a beam of forward-directed light limited to a narrow cone around $\theta=0°$.

Another issue is that unlike an incandescent filament, an LED chip or other solid state lighting device typically cannot be operated efficiently using standard 110V or 220V a.c. power. Rather, on-board electronics are typically provided to convert the a.c. input power to d.c. power of lower voltage amenable for driving the LED chips. As an alternative, a series string of LED chips of sufficient number can be directly operated at 110V or 220V, and parallel arrangements of such strings with suitable polarity control (e.g., Zener diodes) can be operated at 110V or 220V a.c. power, albeit at substantially reduced power efficiency. In either case, the electronics constitute additional components of the lamp base as compared with the simple Edison base used in integral incandescent or halogen lamps.

Heat sinking is yet another issue for omnidirectional replacement LED lamps. Heat sinking is employed because LED devices are highly temperature-sensitive as compared with incandescent or halogen filaments. The LED devices cannot be operated at the temperature of an incandescent filament (rather, the operating temperature should be around 100° C. or preferably lower). The lower operating temperature also reduces the effectiveness of radiative cooling. In a usual approach, the base of the LED replacement lamp further includes (in addition to the Edison base connector and the electronics) a relatively large mass of heat sinking material positioned contacting or otherwise in good thermal contact with the LED device(s).

The combination of electronics and heat sinking results in a large base that blocks "backward" illumination, which has heretofore substantially limited the ability to generate omnidirectional illumination using an LED replacement lamp. The heat sink in particular preferably has a large volume and also large surface area in order to dissipate heat away from the lamp by a combination of convection and radiation.

BRIEF SUMMARY

In some embodiments disclosed herein as illustrative examples, a light emitting apparatus comprises: an LED-based light source; a spherical, spheroidal, or toroidal diffuser generating a light intensity distribution output responsive to illumination inside the diffuser; and a base including a base connector. The LED based light source, the diffuser, and the base are secured together as a unitary LED lamp installable in a lighting socket by connecting the base connector with the lighting socket. The diffuser is shaped and arranged respective to the LED based light source in the unitary LED lamp to conform with an isolux surface of the LED based light source. The base is operatively connected with the LED based light source in the unitary LED lamp to electrically power the LED based light source using electrical power received at the base connector.

In some embodiments disclosed herein as illustrative examples, a light emitting apparatus comprises: a light assembly including an LED-based light source optically coupled with and arranged tangential to a spherical or spheroidal diffuser; and a base including a base connector, the base configured to electrically power the LED based light source using electrical power received at the base connector. The light assembly and base are secured together as a unitary LED lamp installable in a lighting socket by connecting the base connector with the lighting socket.

In some embodiments disclosed herein as illustrative examples, a light emitting apparatus comprises: a light assembly including a ring shaped LED-based light source optically coupled with a toroidal diffuser; and a base including a base connector and configured to electrically power the ring shaped LED based light source using electrical power received at the base connector. The light assembly and base are secured together as a unitary LED lamp installable in a lighting socket by connecting the base connector with the lighting socket.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION OF PREFERRED EMBODIMENTS

Figure 2:
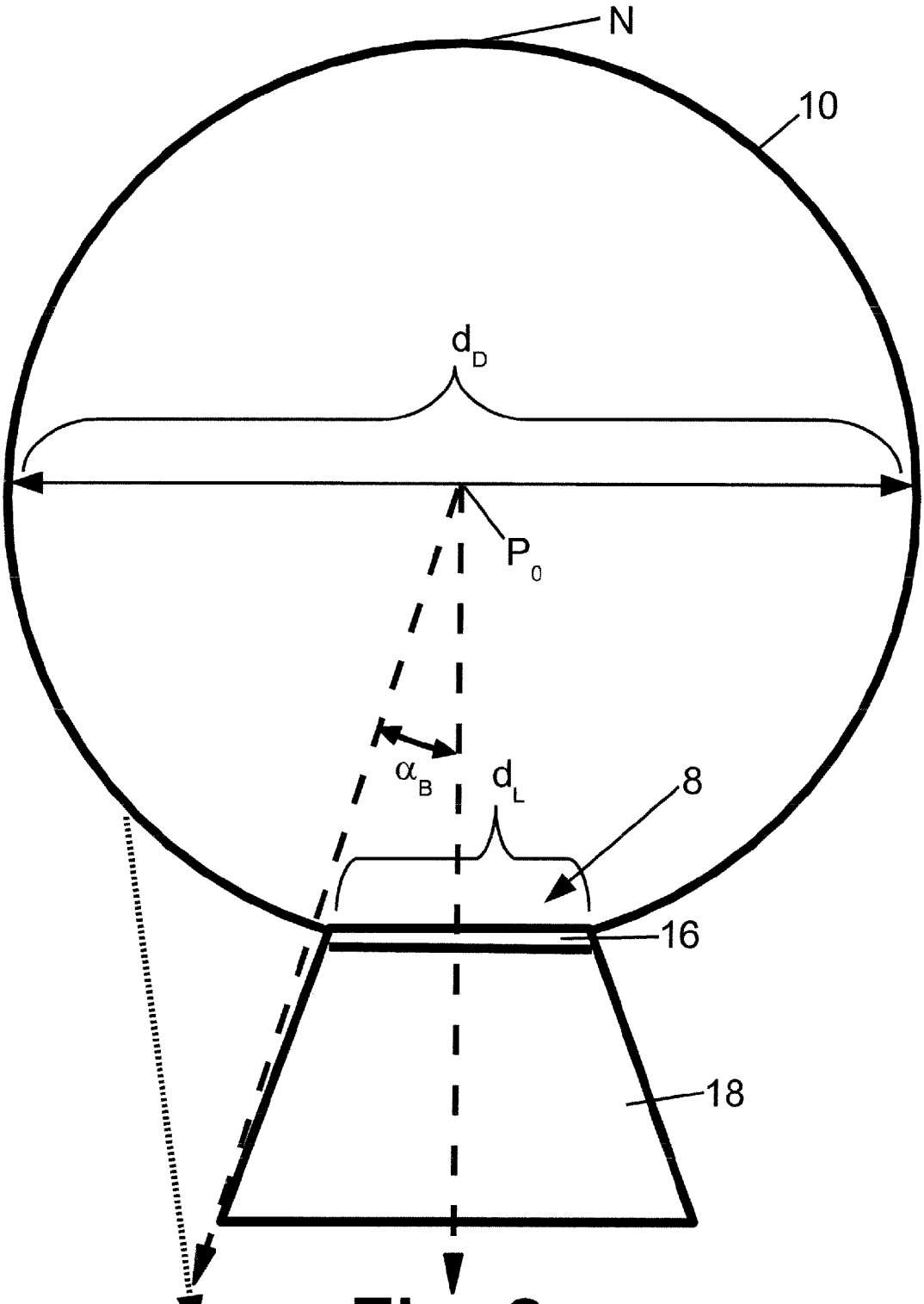
FIG. 2 diagrammatically shows a side view of an omnidirectional LED-based lamp employing a planar LED-based Lambertian light source and a spherical diffuser.
Figure 3:
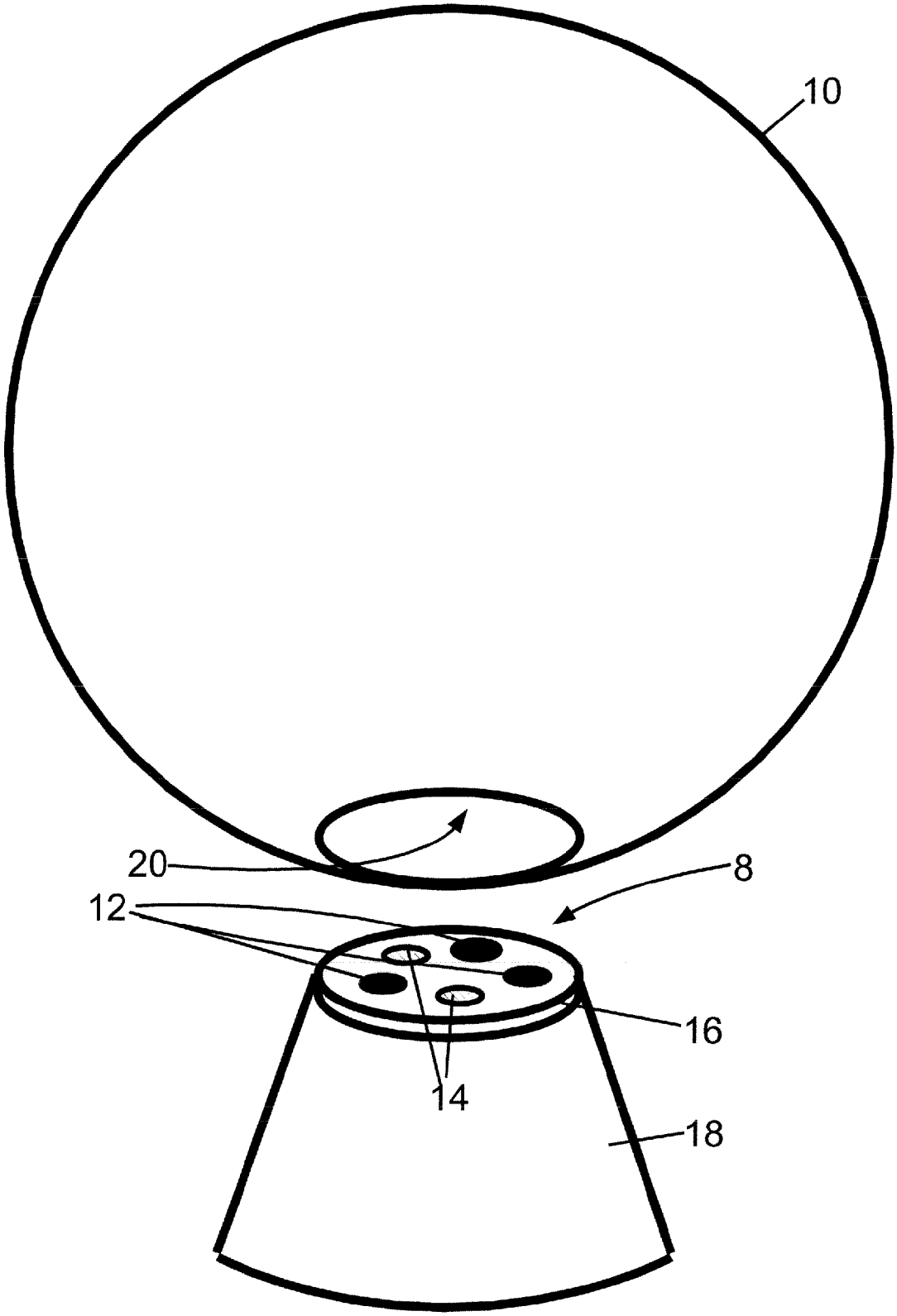
FIG. 3 diagrammatically shows the omnidirectional LED-based lamp of FIG. 2 with the spherical diffuser lifted away to reveal the planar LED-based lambertian light source.

With reference to FIGS. 2 and 3, an LED-based lamp includes a planar LED-based Lambertian light source 8 and a light-transmissive spherical diffuser 10. The planar LED-based Lambertian light source 8 is best seen in the partially disassembled view of FIG. 3 in which the diffuser 10 is pulled away and the planar LED-based Lambertian light source 8 is tilted into view. The planar LED-based Lambertian light source 8 includes a plurality of light emitting diode (LED) devices 12, 14, which in the illustrated embodiment include first LED devices 12 and second LED devices 14 having respective spectra and intensities that mix to render white light of a desired color temperature and CRI. For example, in some embodiments the first LED devices 12 output white light having a greenish rendition (achievable, for example, by using a blue- or violet-emitting LED chip that is coated with a suitable "white" phosphor) and the second LED devices 14 output red light (achievable, for example, using a GaAsP or AlGaInP or other epitaxy LED chip that naturally emits red light), and the light from the first and second LED devices 12, 14 blend together to produce improved white rendition. On the other hand, it is also contemplated for the planar LED-based Lambertian light source to comprise a single LED device, which may be a white LED device or a saturated color LED device or so forth.

The LED devices 12, 14 are mounted on a circuit board 16, which is optionally a metal core printed circuit board (MCPCB). Optionally, a base element 18 provides support and is also thermally conductive so that the base element 18 also defines a heat sink 18 having a substantial thermal conductance for heat sinking the LED devices 12, 14.

The illustrated light-transmissive spherical diffuser 10 is substantially hollow and has a spherical surface that diffuses light. In some embodiments, the spherical diffuser 10 is a glass element, although a diffuser of another light-transmissive material such as plastic or other material is also contemplated. The surface of the diffuser 10 may be inherently light-diffusive, or can be made light-diffusive in various ways, such as: frosting or other texturing to promote light diffusion; coating with a light-diffusive coating such as enamel paint, or a Soft-White or Starcoat™ diffusive coating (available from General Electric Company, New York, USA) of a type used as a light-diffusive coating on the glass bulbs of some incandescent or fluorescent light bulbs; embedding light-scattering particles in the glass, plastic, or other material of the spherical diffuser 10; various combinations thereof; or so forth.

The diffuser 10 optionally may also include a phosphor, for example coated on the spherical surface, to convert the light from the LEDs to another color, for example to convert blue or ultraviolet (UV) light from the LEDs to white light. In some such embodiments, it is contemplated for the phosphor to be the sole component of the diffuser 10. In such embodiments, the phosphor should be a diffusing phosphor. In other contemplated embodiments, the diffuser includes a phosphor plus an additional diffusive element such as frosting, enamel paint, a coating, or so forth.

The light-transmissive spherical diffuser 10 includes an aperture or opening 20 sized to receive or mate with the planar LED-based Lambertian light source 8 such that the light-emissive principle surface of the planar LED-based Lambertian light source 8 faces into the interior of the spherical diffuser 10 and emits light into the interior of the spherical diffuser 10. The spherical diffuser is large compared with the area of the planar LED-based Lambertian light source 8 so that the light source 8 is arranged at a periphery of the substantially larger spherical diffuser 10; in the illustrated embodiment, the spherical diffuser 10 has a diameter $d_D$ while the planar LED-based Lambertian light source 8 (or, equivalently, the mating aperture or opening 20) has a circular area of diameter $d_L$ where $d_D>d_L$. The planar LED-based Lambertian light source 8 is mounted at or in the aperture or opening 20 with its planar light-emissive surface arranged tangential to the curved surface of the spherical diffuser 10. It will be appreciated that exact tangency is achieved only for the ideal case of $d_L/d_D$ approaching zero, but the tangency becomes closer to exact as the ratio $d_D/d_L$ increases, that is, as the size of the planar LED-based Lambertian light source 8 decreases respective to the size of the spherical diffuser 10.

Figure 1:
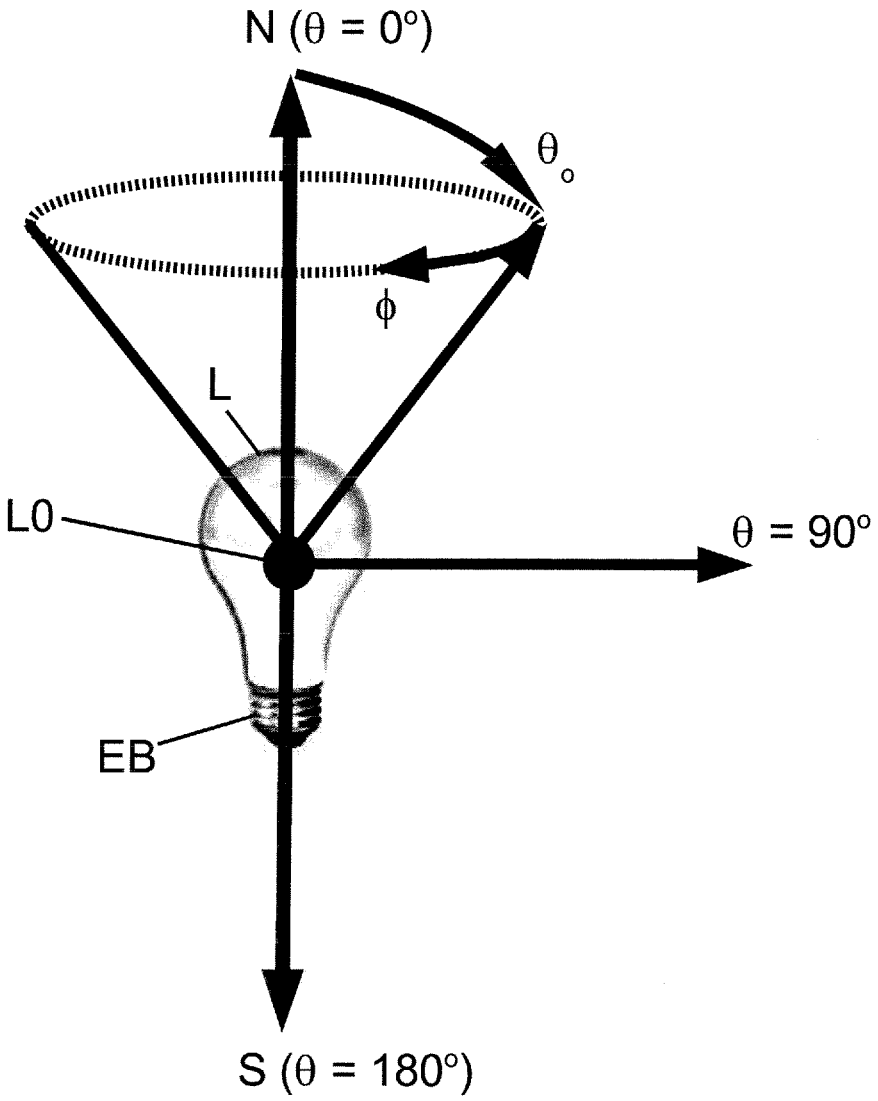
FIG. 1 diagrammatically shows, with reference to a conventional incandescent light bulb, a coordinate system that is used herein to describe illumination distributions.
Figure 4:
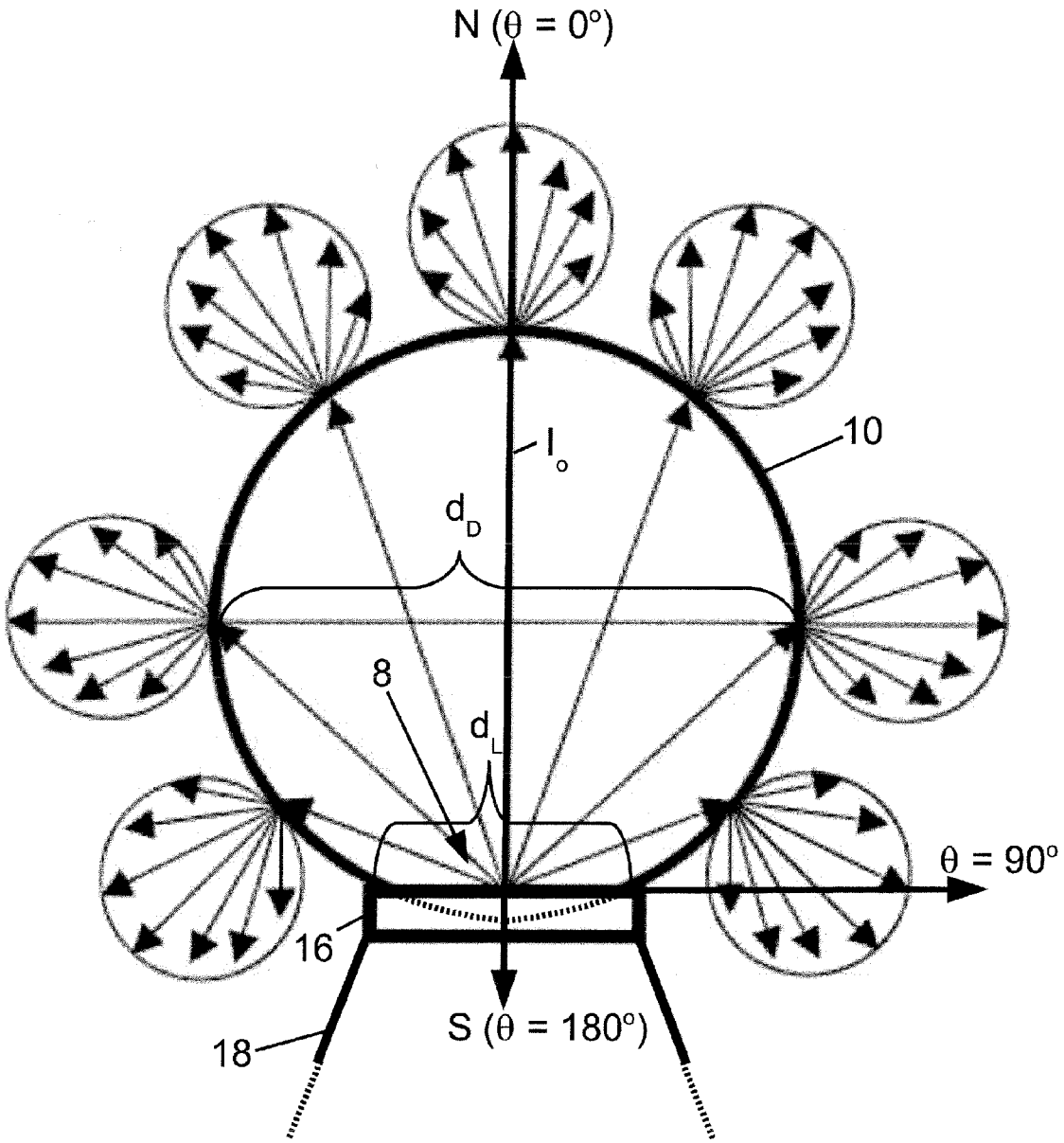
FIG. 4 diagrammatically illustrates using ray tracing diagrams how the omnidirectional LED-based lamp of FIGS. 2 and 3 generates a substantially omnidirectional illumination distribution.

With continuing reference to FIGS. 2 and 3, and with further reference to FIG. 4, the LED-based lamp is also describable using the spherical coordinates system of FIG. 1, where the planar LED-based Lambertian light source 8 defines the coordinate system. Thus, the forward beam of the planar LED-based Lambertian light source 8 along the optical axis is in the north direction) ($\theta=0°$), where the intensity is maximum (denoted here as $I_o$). In accordance with a Lambertian distribution, the intensity decreases with increasing elevation or latitude (using the spherical coordinate convention of FIG. 1) away from the optical axis, so that the intensity at a latitude $\theta$ is $I=I_o\cdot\cos(\theta)$. It should be noted that the LED-based lamp of FIGS. 2-4 is rotationally symmetric about the optical axis and so there is no intensity variation respective to the azimuthal or longitudinal coordinate $\phi$.

With particular reference to FIG. 4, the LED-based lamp of FIGS. 2-4 generates omnidirectional illumination over an elevational or latitudinal range substantially greater than $\theta=[0°, 90°]$. Two points are recognized herein. First, with the planar LED-based Lambertian light source 8 placed tangentially to the spherical diffuser 10, the Lambertian illumination output by the planar LED-based Lambertian light source 8 is uniform over the entire (inside) surface of the spherical diffuser 10. In other words, the flux (lumens/area), typically measured in units of lux (lumens/$m^2$), of light shining on the (inside) surface of the spherical diffuser 10 is of the same value at any point on the spherical diffuser 10. Thus, the inside surface of the diffuser coincides with an isolux surface of the LED light source. Qualitatively, this can be seen as follows. The forward-directed beam of the Lambertian light source has a maximum value $I_o$ at $\theta=0°$; however, this forward-directed portion of the beam having intensity $I_o$ also travels the furthest before impinging on the (inside) surface of the spherical diffuser 10. The intensity decreases with the square of distance, and so the intensity is proportional to $I_o/d_D^2$ (where exact tangency of the light source 8 and the curvature of the diffuser 10 is here assumed as a simplification). At an arbitrary latitude $\theta$, the intensity from the source is lower, namely $I_o\cdot\cos(\theta)$; however, the distance traveled $d=d_D\cdot\cos(\theta)$ before impinging on the spherical diffuser 10 is lower by an amount $\cos(\theta)$ and the projected surface area on which the intensity is received at the spherical diffuser is also reduced by the factor $\cos(\theta)$. Thus, the flux density at the surface at any latitude $\theta$ is proportional to $(I_o\cdot\cos(\theta)\cdot\cos(\theta))/(d_D\cdot\cos(\theta))^2$=constant, which is the same as at $\theta=0$. Thus, for the case of a Lambertian intensity distribution emitted by the LED light source, the inside surface of a spherical diffuser having the LEDs positioned tangentially on the surface of the spherical diffuser is coincident with an isolux contour surface of the intensity distribution of the LEDs.

The second point recognized herein is that the diffuser 10 (assuming ideal light diffusion) emits a Lambertian light intensity distribution output at any point on its surface responsive to illumination inside the diffuser 10 by the LED-based light source 8. In other words, the light intensity output at a point on the surface of the diffuser 10 responsive to illumination inside the spherical or spheroidal diffuser scales with $\cos(\phi)$ where $\phi$ is the viewing angle respective to the diffuser surface normal at that point. This is diagrammatically illustrated in FIG. 4 by showing the ray tracing diagrams for seven direct rays emitted by the planar LED-based Lambertian light source 8. At the point where each direct ray impinges on the surface of the light-transmissive spherical diffuser 10, it is diffused into a Lambertian output emitted from the (outside) surface of the spherical diffuser 10. As is known in the optical arts, a surface emitting light in a Lambertian distribution appears to have the same intensity (or brightness) regardless of viewing angle, because at larger viewing angles respective to the surface normal the Lambertian decrease in output intensity is precisely offset by the smaller perceived viewing area due to the oblique viewing angle. Since the entire surface of the spherical diffuser 10 is illuminated with the same intensity (the first point set forth in the immediately preceding paragraph) the result is that an outside viewer observes the spherical diffuser 10 to emit light with uniform intensity at all viewing angles, and with spatially uniform source brightness at the surface of the diffusing sphere.

In embodiments in which the diffuser 10 comprises a wavelength-converting phosphor, the phosphor should be a diffusing phosphor, that is, a phosphor that emits the wavelength-converted light in a Lambertian (or nearly Lambertian) pattern as illustrated in FIG. 4, independent of the angle-of-incidence of the direct (excitation) illumination. The diffusing nature of the phosphor is controlled by parameters such as phosphor layer thickness, phosphor particle size and reflectivity (which affects the performance of the phosphor as a light scatterer), and so forth. If the phosphor layer is insufficiently scattering, then the phosphor can be combined with additional diffusion components such as frosting of the glass or other substrate, including an enamel paint layer, or so forth.

At the same time, the spherical diffuser 10 provides excellent color mixing characteristics through the light diffusion process, without the need for multiple bounces through additional optical elements, or the use of optical components that result in loss or absorption of the light. Still further, since the planar LED-based Lambertian light source 8 is designed to be small compared with the spherical diffuser 10 (that is, the ratio $d_D/d_L$ should be large) it follows that the backward light shadowing is greatly reduced as compared with existing designs employing hemispherical diffusers, in which the planar LED-based Lambertian light source is placed at the equatorial plane $\theta=90°$ and has the same diameter as the hemispherical diffuser (corresponding to the limit in which $d_D/d_L=1$).

The configuration of the base 18 also contributes to providing omnidirectional illumination. As illustrated in FIG. 2, the spherical diffuser 10 illuminated by the LED-based Lambertian light source 8 can be thought of from a far-field viewpoint as generating light emanating from a point $P_0$. In other words, a far-field point light source location $P_0$ is defined by the omnidirectional light assembly comprising the light source 8 and diffuser 10. The base 18 blocks some of the "backward"-directed light, so that a latitudinal blocking angle $\alpha_B$ can be defined by the largest latitude $\theta$ having direct line-of-sight to the point $P_0$. FIG. 2 illustrates this. For viewing angles within the blocking angle $\alpha_B$, the base 18 provides substantial shadowing and consequent large decrease in illumination intensity. It should be appreciated that the concept of the latitudinal blocking angle $\alpha_B$ is useful in the far field approximation, but is not an exact calculation—this is shown in FIG. 2, for example, in that a light ray $R_S$ does illuminate within the region of the blocking angle $\alpha_B$. The light ray $R_S$ is present because of the finite size of the spherical diffuser 10 which is only approximated as a point light source $P_0$ at in the far field approximation. The base also reflects some of the backward-directed light, without blocking or absorbing it, and redirects that reflected light into the light distribution pattern of the lamp, adding to the light distribution in the angular zone just above the blocking angle. To accommodate the effect on the light distribution pattern due to reflection of light from the surface of the heat sink and base, the shape of the spherical diffuser may be altered slightly near the intersection of the spherical diffuser and the LED light source in order to improve the uniformity of the distribution pattern in that zone of angles.

In view of the foregoing, the omnidirectionality of the illumination at large latitude angles is seen to be additionally dependent on the size and geometry of the base 18 which controls the size of the blocking angle $\alpha_B$. Although some illumination within the blocking angle $\alpha_B$ can be obtained by enlarging the diameter $d_D$ of the spherical diffuser 10 (for example, as explained with reference to light ray $R_S$), this diameter is typically constrained by practical considerations. For example, if a retrofit incandescent light bulb is being designed, then the diameter $d_D$ of the spherical diffuser 10 is constrained to be smaller than or (at most) about the same size as the incandescent bulb being replaced. As seen in FIG. 2, one suitable base design has sides angled to substantially conform with the blocking angle $\alpha_B$. A base design having sides angled at about the blocking angle $\alpha_B$ provides the largest base volume for that blocking angle $\alpha_B$, which in turn provides the largest volume for electronics and heat sinking mass.

By way of review and expansion, approaches are disclosed herein for designing LED based omnidirectional lamps. In disclosed embodiments of these approaches, the small light source 8 is arranged to emit light of a substantially Lambertian distribution in a 2-$\pi$ steradian half-space above the light source 8. The spherical (or, more generally, spheroidal) diffusing bulb 10 has the small optical input aperture 20 at which the small light source is mounted. At each point on the surface of the diffuser bulb 10 the direct illumination is scattered to generate a substantially Lambertian output light intensity distribution at the exterior of the diffusing bulb 10. This provides a uniformly lit appearance on the surface of the bulb 10, and provides a nearly uniform intensity distribution of light emitted into $4\pi$ steradians surrounding the bulb in all directions, except in the backward direction along the optical axis ($\theta$~180°) where the illumination is shadowed by the light engine 8 by the heat sink and electronics volumes.

Several aspects of such designs are considered in turn. The first aspect is the generally Lambertian distribution of light intensity from a typical LED device or LED package, such as for example the LED light source 8, such that the light intensity is nearly constant along the locus of the spherical diffuser 10 having the LED light source 8 placed at any single position on or near the surface of the sphere (e.g., at the small opening 20). The second aspect of the design is to intercept the Lambertian light distribution pattern with the light diffuser 10 whose diffusion occurs along the locus of nearly constant light flux, by placing the spherical or nearly spherical light diffuser 10 adjacent to the LED light source 8 such that the LED light source 8 is on or near the surface of the spherical diffuser 10, with the LED light source 8 directing its forward illumination along the optical axis ($\theta=0$) to an opposite point of the spherical diffuser 10 that is most distant from the optical input aperture 20. This arrangement ensures that the illuminance (lumens per surface area) of light shining onto the spherical light diffuser 10 is nearly constant across the entire (inside) surface of the spherical diffuser 10. The third aspect is a substantially Lambertian scattering distribution function of the light diffuser 10, such that a nearly Lambertian distribution of intensity versus angle is emitted from each (exterior) point on the light diffuser 10. This ensures that the light intensity (lumens per steradian) is nearly constant in all directions. The fourth aspect is that the maximum lateral dimension $d_L$ of the LED light source 8 should be substantially smaller than the diameter $d_D$ of the spherical light diffuser 10 in order to preserve the near-ideality of the first, second, and third aspects. If the LED light source 8 is too large relative to the spherical diffuser 10, then the first aspect will be compromised such that the illuminance on the surface of the light-diffusing sphere will deviate significantly from perfect uniformity. Further, if the LED light source 8 is too large relative to the spherical diffuser 10, then the third aspect will be compromised and the LED light source 8 will block a significant fraction of the potential 4π steradians into which an ideal spherical light diffuser would otherwise emit light. (Or, in other words, if the LED light engine 8 is too large it will block an undesirably large portion of the backward directed light). The fifth aspect is that the base 18 should be designed to minimize the blocking angle $\alpha_B$ and to provide a base volume large enough to provide adequate heat sinking and space for electronics.

Figure 5:
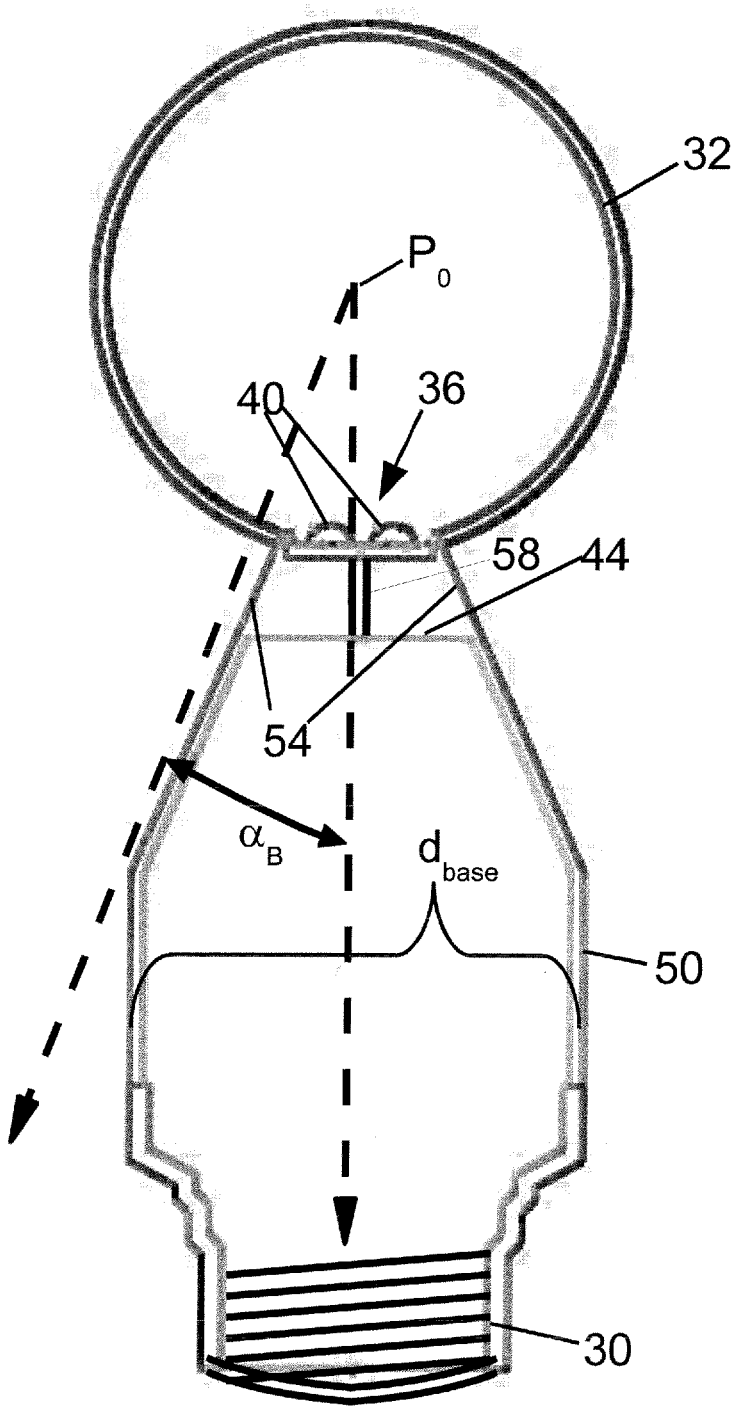
FIGS. 5 and 6 show side views of two illustrative LED-based lamps employing the principles of the lamp of FIGS. 2-4 and each further including an Edison base enabling installation in a conventional incandescent lamp socket.
Figure 6:
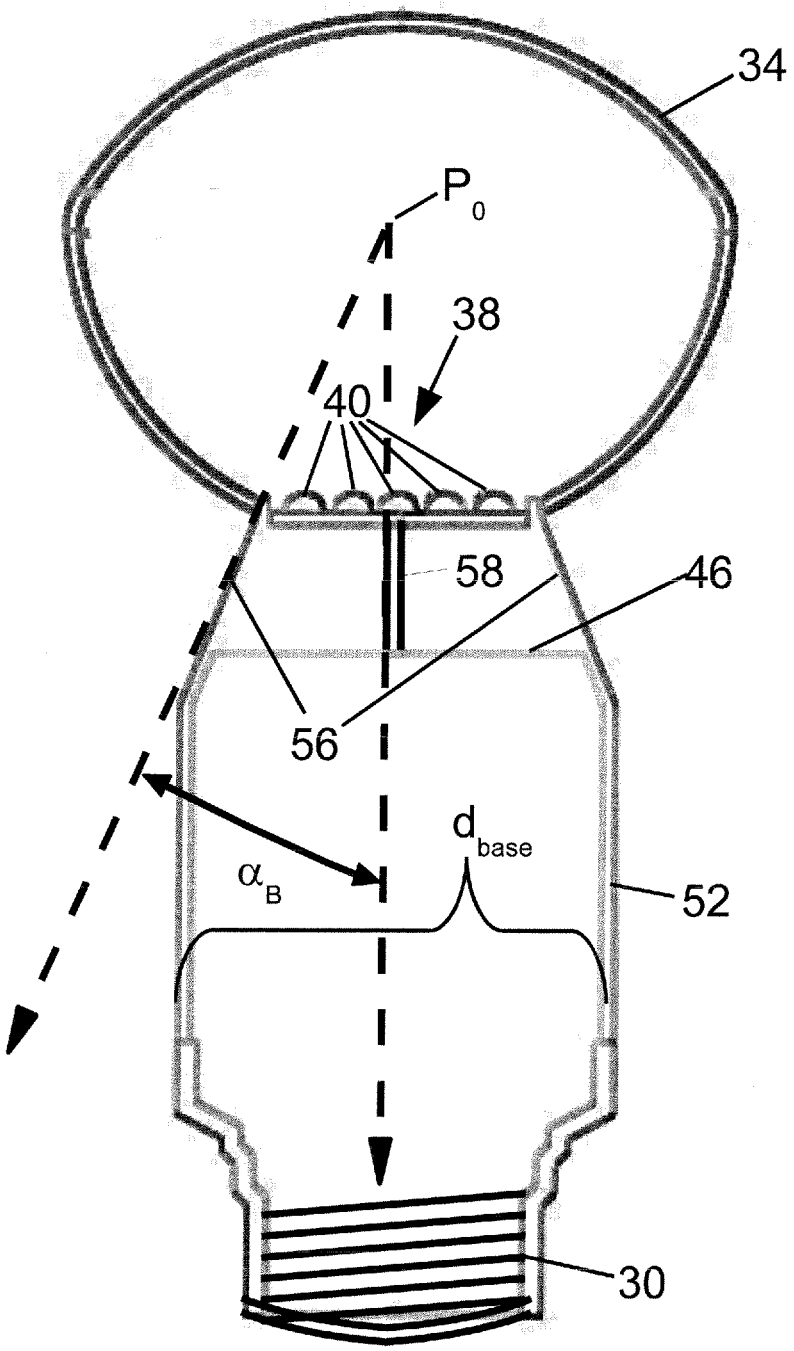

With reference to FIGS. 5 and 6, embodiments of this design are illustrated which are configured as a unitary LED lamp suitable for replacing a conventional incandescent or halogen light bulb. Each of the LED-based lamps of FIGS. 5 and 6 includes an Edison-type threaded base connector 30 that is formed to be a direct replacement of the Edison base of a conventional incandescent lamp. (More generally, the base connector should be of the same type as the base of the incandescent or halogen lamp to be replaced—for example, if the incandescent or halogen lamp employs a bayonet base then the Edison base connector 30 is suitably replaced by the requisite bayonet base connector). The unitary LED lamp of FIG. 5 (or FIG. 6) is a self-contained omnidirectional light emitting apparatus that does not rely upon the lighting socket for heat sinking. As such, the unitary LED lamp of FIG. 5 (or FIG. 6) can be substituted for a conventional integral incandescent or halogen lamp without concern about thermally overloading the socket or associated hardware, and without modifying the electrical configuration of the socket. The LED lamps of FIGS. 5 and 6 include respective spherical or spheroidal diffusers 32, 34 and respective planar LED-based light sources 36, 38 arranged tangentially to a bottom portion of the respective spherical diffuser 32, 34. The LED-based light sources 36, 38 are configured tangentially respective to the spherical or spheroidal diffusers 32, 34, and include LED devices 40. In FIG. 5, the LED-based light source 36 includes a small number of LED devices 40 (two illustrated), and provides a substantially Lambertian intensity distribution that is coupled with the spherical diffuser 32. In FIG. 6 the LED-based light source 38 includes a relatively larger number of LED devices 40 (five illustrated). The light source 38 produces a light output distribution that is a distorted Lambertian distribution in that it is relatively more spread out in the plane of the LED-based light source 38 as compared with an exact Lambertian distribution. To accommodate this distortion from the exact Lambertian distribution, the diffuser 34 of FIG. 6 is spheroidal, that is, deviates from perfect spherical. In the illustrated example of FIG. 6, the distorted Lambertian distribution output by the LED-based light source 38 can be described as a Lambertian distribution with oblate distortion, and is suitably captured by the diffuser 34 having an oblate spheroidal shape. Such accommodation of inexact Lambertian light distributions is further discussed with reference to FIGS. 7 and 8.

With continuing reference to FIGS. 5 and 6, an electronic driver 44 is interposed between the planar LED light source 36 and the Edison base connector 30, as shown in FIG. 5. Similarly, an electronic driver 46 is interposed between the planar LED light source 38 and the Edison base connector 30, as shown in FIG. 6. The electronic drivers 44, 46 are contained in respective lamp bases 50, 52, with the balance of each base 50, 52 (that is, the portion of each base 50, 52 not occupied by the respective electronics 44, 46) being preferably made of a heat-sinking material so as to define the heat sink. The electronic driver 44, 46 is sufficient, by itself, to convert the a.c. power received at the Edison base electrical connector 30 (for example, 110 volt a.c. of the type conventionally available at Edison-type lamp sockets in U.S. residential and office locales, or 220 volt a.c. of the type conventionally available at Edison-type lamp sockets in European residential and office locales, or 12 volt or 24 volt or other voltage d.c.) to a form suitable for driving the LED-based light source 36, 38. In embodiments in which the LED light source is configured to be operated directly from the 110 volt or 220 volt a.c. (for example, if the LED-based light source includes a series string of LED devices numbered to operate directly from the a.c., optionally with Zener diodes to accommodate the a.c. polarity switching), the electronic drivers 44, 46 are suitably omitted.

It is desired to make the base 50, 52 large in order to accommodate a large electronics volume and in order to provide adequate heat sinking, but is preferably configured to minimize the blocking angle $\alpha_B$. Moreover, the heat sinking is not predominantly conductive via the Edison base 30, but rather relies primarily upon a combination of convective and radiative heat dissipation into the ambient air—accordingly, the heat sink defined by the base 50, 52 should have sufficient surface area to promote the conductive and radiative heat dissipation. On the other hand, it is further recognized herein that the LED-based light source 36, 38 is preferably of small diameter due to its tangential arrangement respective to the diffuser 32, 34. These diverse considerations are accommodated in the respective bases 50, 52 by employing a small receiving or mating area for connection with the LED-based light source 36, 38 which is sized approximately the same as the LED-based light source 36, 38, and having angled sides 54, 56 with angles that are about the same as the blocking angle $\alpha_B$. The angled base sides 54, 56 extend away from the LED-based light source 36, 38 for a distance sufficient to enable the angled sides 54, 56 to meet with a cylindrical base portion of diameter $d_{base}$ which is large enough to accommodate the electronics 44, 46.

The base geometry design is thus controlled by the blocking angle $\alpha_B$, which in turn is controlled by the desired latitude range of substantially omnidirectional illumination. For example, if it is desired to have substantially omnidirectional illumination over a range θ=[0°, 150°], then the blocking angle $\alpha_B$ should be no larger than about 30°, and in some such designs the blocking angle is about 30° in order to maximize the base size for accommodating heat sinking and electronics. Said another way, the light assembly generates illumination with uniformity variation of ±30% or less (e.g., more preferably ±20%, or more preferably ±10%) over at least a latitudinal range θ=[0°,X] where X is a latitude and X≥120°. The base 50, 52 does not extend into the latitudinal range θ=[0°, X], but is preferably made large with substantial surface area. This can be achieved by constructing the base 50, 52 with sides 54, 56 lying along the latitude X.

Said yet another way, the blocking angle $\alpha_B$ is kept small by ensuring that the base is smallest at its connection with the lighting assembly comprising the diffuser and the LED-based light source, and flares out or increases in cross-sectional area (e.g., diameter) as it extends away from the lighting assembly in order to provide a sufficient volume and surface area for convective and radiative heat sinking, and optionally also for accommodation of electronics. In some embodiments, such as those of FIGS. 5 and 6, the base 50, 52 at its connection with the lighting assembly is sized to have area about the same as the area of the LED-based light source 36, 38, and the sides 54, 56 are angled out at the maximum allowable angle (that is, at an angle about equal to the blocking angle $\alpha_B$) in order to place the maximum volume of heat sinking material adjacent the LED-based light source 36, 38 while respecting the blocking angle design constraint.

As seen in FIGS. 5 and 6, the lamp base 50, 52 includes a heat-sinking portion immediately adjacent the LED-based light source 36, 38 and between the LED-based light source 36, 38 and its driving electronics 44, 46. Accordingly, an electrical path 58 is provided through the heat sinking portion of the base to electrically connect the electronics 44, 46 and the light source 36, 38. On the other hand, the electronic unit 44, 46 is directly adjacent (or, in an alternative viewpoint, extends to include) the Edison base connector 30.

Figure 7:
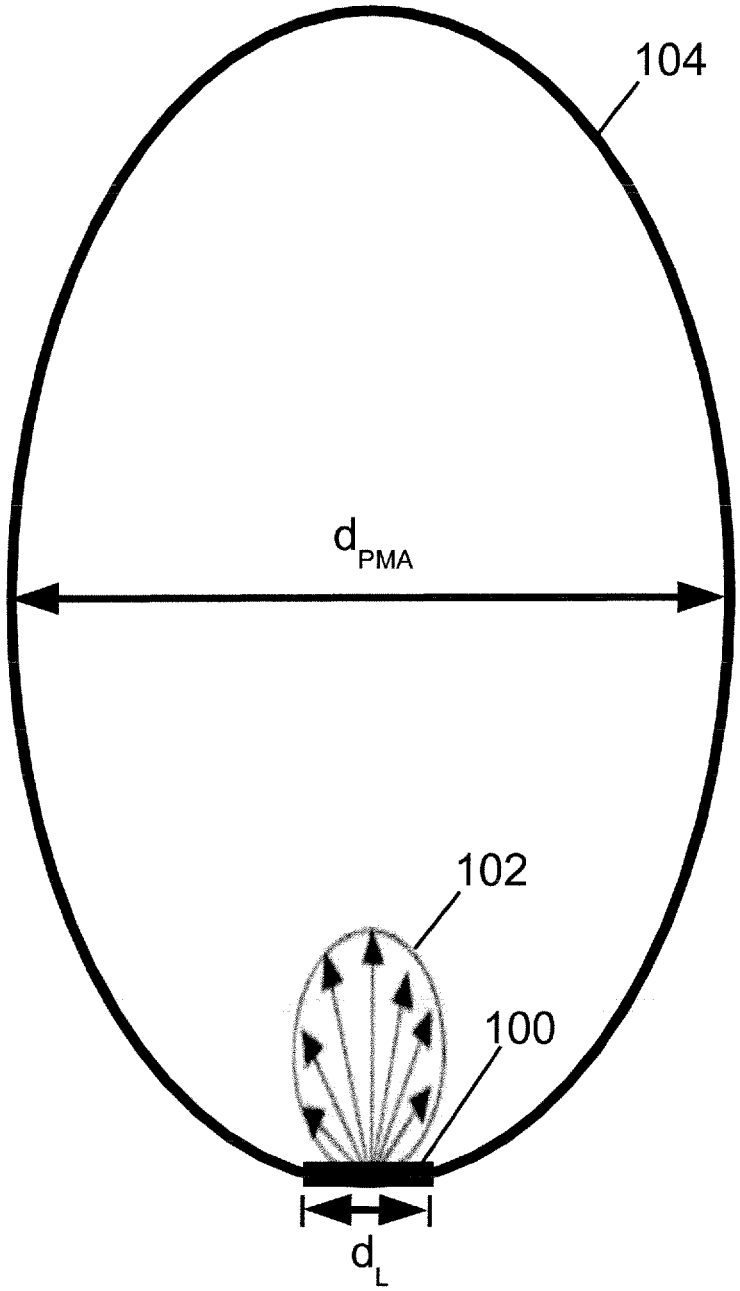
FIG. 7 diagrammatically illustrates a side view of a variation on the embodiment of FIGS. 2-4 in which the light source emits a prolate-distorted Lambertian intensity distribution, and the diffuser is a prolate spheroidal diffuser having a shape matching the light source intensity distribution.

With reference to FIG. 7, in some embodiments the light source may generate something other than a Lambertian intensity distribution. In the illustrative example of FIG. 7, a light source 100 generates a substantially distorted Lambertian intensity distribution 102. The intensity distribution 102 has similarity with a Lambertian intensity distribution in that it is strongest in the forward direction (i.e., along the optical axis or along $\theta=0°$) and decreases with increasing latitude $\theta$ with zero intensity for $\theta \geq 90°$. However, the intensity distribution 102 is substantially distorted respective to a true Lambertian distribution in that a substantially greater fraction of the total intensity is in the forward direction, as diagrammatically indicated by ray traces in FIG. 7. The type of distortion exhibited by the Lambertian intensity distribution 102 shown in FIG. 7 is sometimes referred to as a prolate distortion. For such embodiments, the ratio $d_D/d_L$ discussed with reference to spherical diffuser embodiments (e.g., FIGS. 2-4) is suitably replaced by the ratio $d_{PMA}/d_L$, where $d_{PMA}$ is the minor axis of the prolate-distorted spheroidal diffuser as shown in FIG. 7.

Figure 8:
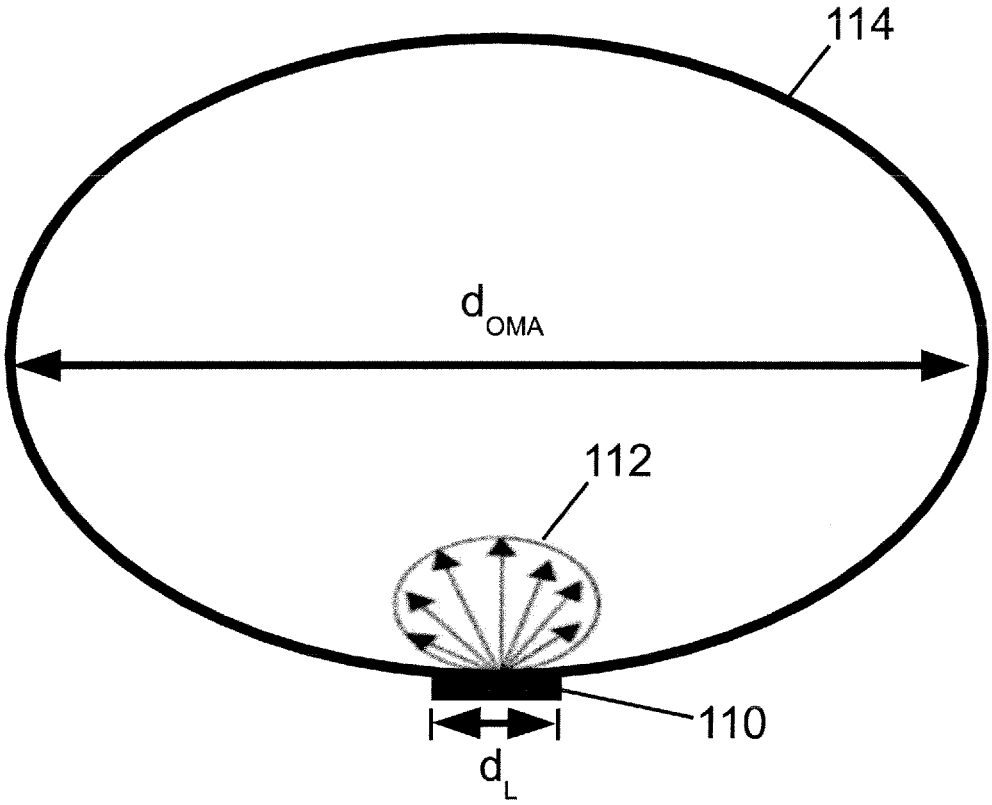
FIG. 8 diagrammatically illustrates a side view of a variation on the embodiment of FIGS. 2-4 in which the light source emits a oblate-distorted Lambertian intensity distribution, and the diffuser is a oblate spheroidal diffuser having a shape matching the light source intensity distribution.

With reference to FIG. 8, as another example a light source 110 generates a distorted Lambertian intensity distribution 112 that has a substantial oblate distortion. The substantially oblate-distorted Lambertian intensity distribution 112 is distorted respective to a true Lambertian distribution in that a substantially lesser fraction of the total intensity is in the forward direction, as diagrammatically indicated by ray traces in FIG. 8. An oblate spheroidal diffuser 114 is arranged to diffuse the oblate-distorted Lambertian intensity distribution 112. For such embodiments, the ratio $d_D/d_L$ discussed with reference to spherical diffuser embodiments (e.g., FIGS. 2-4) is suitably replaced by the ratio $d_{PMA}/d_L$ where $d_{OMA}$ is the major axis of the oblate-distorted spheroidal diffuser as shown in FIG. 8.

In general, distortions from an ideally spherical (Lambertian) distribution may be described as a spheroidal shape, such as an elongated prolate spheroidal distribution 102 (FIG. 7) or a flattened oblate spheroidal distribution (FIG. 8). The design principles set forth herein are readily extended to such situations. With illustrative reference back to the embodiment of FIGS. 2-4, the spherical diffuser 10 is chosen because the Lambertian light source 8 illuminates the spherical diffuser 10 uniformly across its entire (inside) surface. In other words, the spherical diffuser 10 conforms with an isolux curve of the Lambertian light source 8. Generalizing this observation, as long as the light-transmissive diffuser is selected to conform with an isolux surface respective to the light source, it is assured that the entire surface of the diffuser will be illuminated with uniform intensity by the light source. Additionally, because the diffuser provides Lambertian scattering as illustrated by way of example in FIG. 4, light emanating from each point of the (outside of the) diffuser surface has a Lambertian distribution. Thus, the resulting lamp output intensity will be substantially omnidirectional. Some deviation from ideal omnidirectionality may be observed in the case of the prolate or oblate spheroidal diffusers 104, 114 due to these shapes deviating from ideally spherical; however, this deviation is relatively small for light source intensity distributions that do not deviate too far from a Lambertian distribution.

Applying these generalized design principles to the embodiment of FIG. 7, the spherical diffuser 10 of the embodiment of FIGS. 2-4 is replaced in the embodiment of FIG. 7 by the prolate spheroidal diffuser 104 which matches an isolux surface of the prolate-distorted Lambertian intensity 102 generated by the light source 100. Qualitatively, this prolate spheroidal diffuser 104 can be seen as compensating for the higher intensity fraction in the forward ($\theta=0$) direction of the output intensity 102 by moving the diffuser surface along the forward ($\theta=0$) direction further away from the light source 100.

Figure 10:
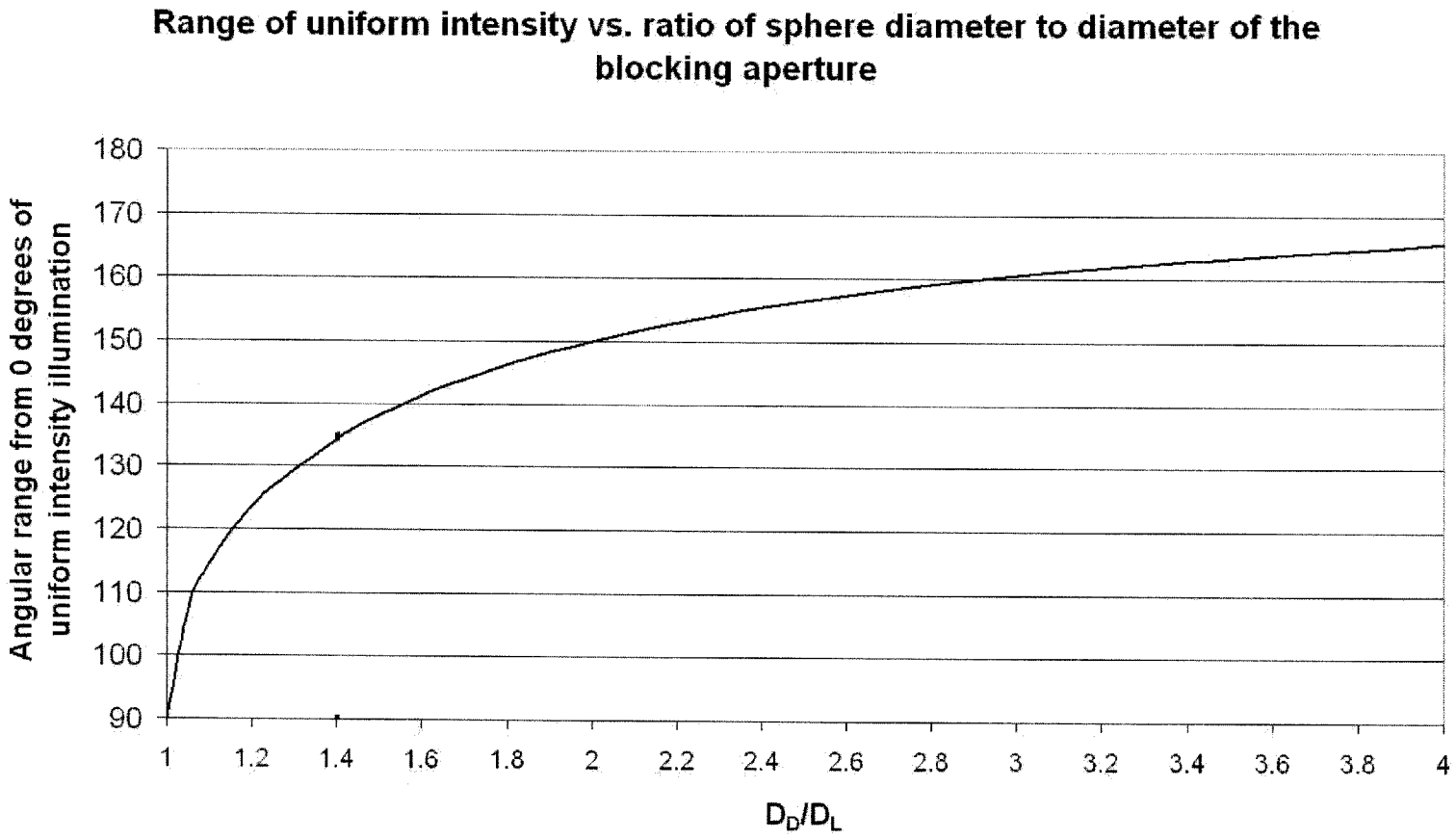
FIG. 10 plots the impact on the latitudinal range of light uniformity of the ratio of a spherical diffuser diameter to the LED-based light source size.

In the case of the embodiment of FIG. 8, the spherical diffuser 10 of the embodiment of FIGS. 2-4 is replaced in the embodiment of FIG. 10 by the oblate spheroidal diffuser 114 which matches an isolux surface of the oblate-distorted Lambertian intensity 112 generated by the light source 110. Qualitatively, this oblate spheroidal diffuser 114 can be seen as compensating for the lower intensity fraction in the forward ($\theta=0$) direction of the output intensity 112 by moving the diffuser surface along the forward ($\theta=0$) direction closer to the light source 110.

More generally, it will be appreciated that substantially any light source illumination distribution can be similarly accommodated, by choosing a diffuser whose surface corresponds with an isolux surface of the light source. Indeed, variation in the azimuthal or longitudinal direction $\phi$ can be accommodated in this same way, by accounting for the variation in the azimuthal or longitudinal direction $\phi$ in defining the isolux surface. As previously noted, the light distribution can also be affected by secondary factors such as reflection from the base. Such secondary distortions can be accommodated by slight adjustment of the diffuser shape. In some embodiments, for example, the light distribution pattern generated by the light source may be Lambertian with very slight prolate distortion, but in view of the secondary affect of base reflection a spherical diffuser with a slight oblate shape distortion may be selected as providing the optimal lamp intensity distribution.

Having described some illustrative embodiments with reference to FIGS. 2-8, some further disclosure along with description of actual reduction to practice and characterization thereof is next set forth.

The following omnidirectional LED lamp design aspects are set forth herein. A first design aspect relates to the distribution of light intensity emitted by the LED light source. The distribution for most typical LED light sources is Lambertian, although other distributions exist for LED light sources, such as distorted Lambertian (e.g., FIGS. 7 and 8). The intensity distribution from an LED light source is typically uniform, or nearly uniform, in the azimuthal or longitudinal ($\phi$) direction (that is, the intensity distribution is expected to be substantially axially symmetric). The first design aspect entails identifying the intensity distribution of the LED light source, so that the transparent diffuser can be constructed to conform with an isolux surface of the LED light source. For the Lambertian intensity distribution, the intensity versus latitude angle ($\theta$) is proportional to $\cos(\theta)$, where $\theta$ is the angle measured from the optical axis as shown in FIG. 1. An ideal Lambertian distribution is uniform in the $\phi$ direction, and the distribution in the $\phi$ direction is in practice usually nearly uniform for a typical LED light source. The resulting isolux surface is spherical. Some typical distortions from the ideal Lambertian distribution include a prolate distortion having relatively more intensity in the forward direction (as illustrated in FIG. 7) or an oblate distortion having relatively less intensity in the forward direction (as illustrated in FIG. 8). The prolate distortion results in a prolate spheroidal isolux surface, while the oblate distortion results in an oblate spheroidal isolux surface. In the case of having relatively more intensity in the forward direction (prolate distortion, as illustrated in FIG. 7) the long axis of the spheroid aligns with the optical axis. In the case of having relatively less intensity in the forward direction (oblate distortion, as illustrated in FIG. 8), the short axis of the spheroid aligns with the optical axis.

A second design aspect of the design is to construct the light-transmissive diffuser conforming with an isolux surface. If the intensity distribution of the LED light source is exactly Lambertian, then the isolux surface (and hence the diffuser) is spherical, and the ideal location of the light-emitting surface of the LED light source is at a location tangential to the surface of the spherical diffuser. In a physical LED light source, especially one employing multiple LED chips or multiple LED packages, the individual LED devices are usually mounted on a planar circuit board, and the LEDs may be encapsulated, either individually or as an array, with an index-matching substance to enhance the efficiency of light extraction from the LED semiconductor material. The LED light source may also be surrounded by reflective, refractive, scattering, or transmissive optical elements to enhance the uniformity of the light flux or its color from the light engine. To accommodate such a spatially extended LED light source, the exit aperture (that is, the light output surface) of the LED light source is suitably located tangential to the surface of the light diffuser so that the light diffuser may receive uniform illuminance.

If the intensity distribution of the LED light source deviates substantially from a pure Lambertian distribution, then the diffuser is not an exact sphere, but rather is a shape that matches the shape of the light intensity distribution so that the illuminance [lumens/area] is constant at every location on the surface of the diffuser, and the light-emitting surface of the LED light source is at a location tangential to the surface of the diffuser. For example, if the intensity distribution 102 of the LED light source 100 is concentrated in a forward lobe (stretched along the optical axis, as illustrated in FIG. 7) then the diffuser 104 should be elongated along the optical axis to match the shape of the intensity distribution.

Although surface diffusers are illustrated herein, a volume diffuser can also be employed. In a volume diffuser the light diffusion occurs throughout the volume of the diffuser, rather than being concentrated at the surface. In this case the shape of the diffuser should also take into account changes in the intensity distribution due to scattering occurring within the volume of the diffuser.

A third design aspect is to provide Lambertian or nearly Lambertian scattering of the light by the light diffuser. An ideal Lambertian scatterer results in a Lambertian intensity distribution at the output for any possible input distribution, even in the extreme case of a collimated beam of light as the input. Where the input intensity distribution of the light to the diffuser is a Lambertian or approximately Lambertian distribution relative to the optical axis of the LED light source, the function of the diffuser is to redirect that intensity distribution into a Lambertian distribution relative to the normal (that is, perpendicular unit vector) to the surface of the diffuser. A Lambertian scatterer, or a relatively strong near-Lambertian scatterer, is generally sufficient to accomplish this. Various materials that are typically used in existing omnidirectional lamps, such as transparent or translucent glass, quartz, ceramic, plastic, paper, composite, or other optically transmissive material having low optical absorption, can provide Lambertian, or sufficiently strong, scattering. The scattering can be produced by a roughening or frosting of the surface of the scattering medium (for example by chemical etching, or mechanical abrasion, or cutting with a mechanical tool or a laser, or so forth). Additionally or alternatively, the scattering can be produced by a scattering coating or paint or laminate applied to the surface, or by scattering within the bulk medium by suspension of scattering particles in the medium, or by grain boundaries or dopants within the medium (in the case of a heterogeneous medium), or by other scattering mechanisms or combinations thereof.

A fourth design aspect is to minimize the deviation of the actual intensity distribution from that of the ideal uniform, isotropic distribution that would result from the ideal application of the first three aspects. A principle source of deviation from the ideal lamp configuration is the arrangement of the light source at other than precisely tangential respective to a surface of the transparent diffuser. This nonideality can be limited by considering the ratio of the size of the diffuser to the size of the LED light source, for example as set forth by the ratio $d_D/d_L$ in the embodiment of FIGS. 2-4. From the results of an optical ray tracing model, and confirmation by measurements on prototype lamps that are generally intended to replace incandescent light bulbs of the A19 size, having a lamp diameter of about 2⅜" or about 60 mm, a desired range has been quantified for a model and corresponding prototypes in which the LED light source comprises a symmetric array of a large number of closely space LEDs on a relatively small circular circuit board having the diameter $d_L$ in a range of 10 to 20 mm, placed at the "south pole" (that is, at $\theta=180°$) of a spherical glass bulb having the diameter $d_D$, that is coated with a Lambertian scatterer on its inside surface.

Figure 9:
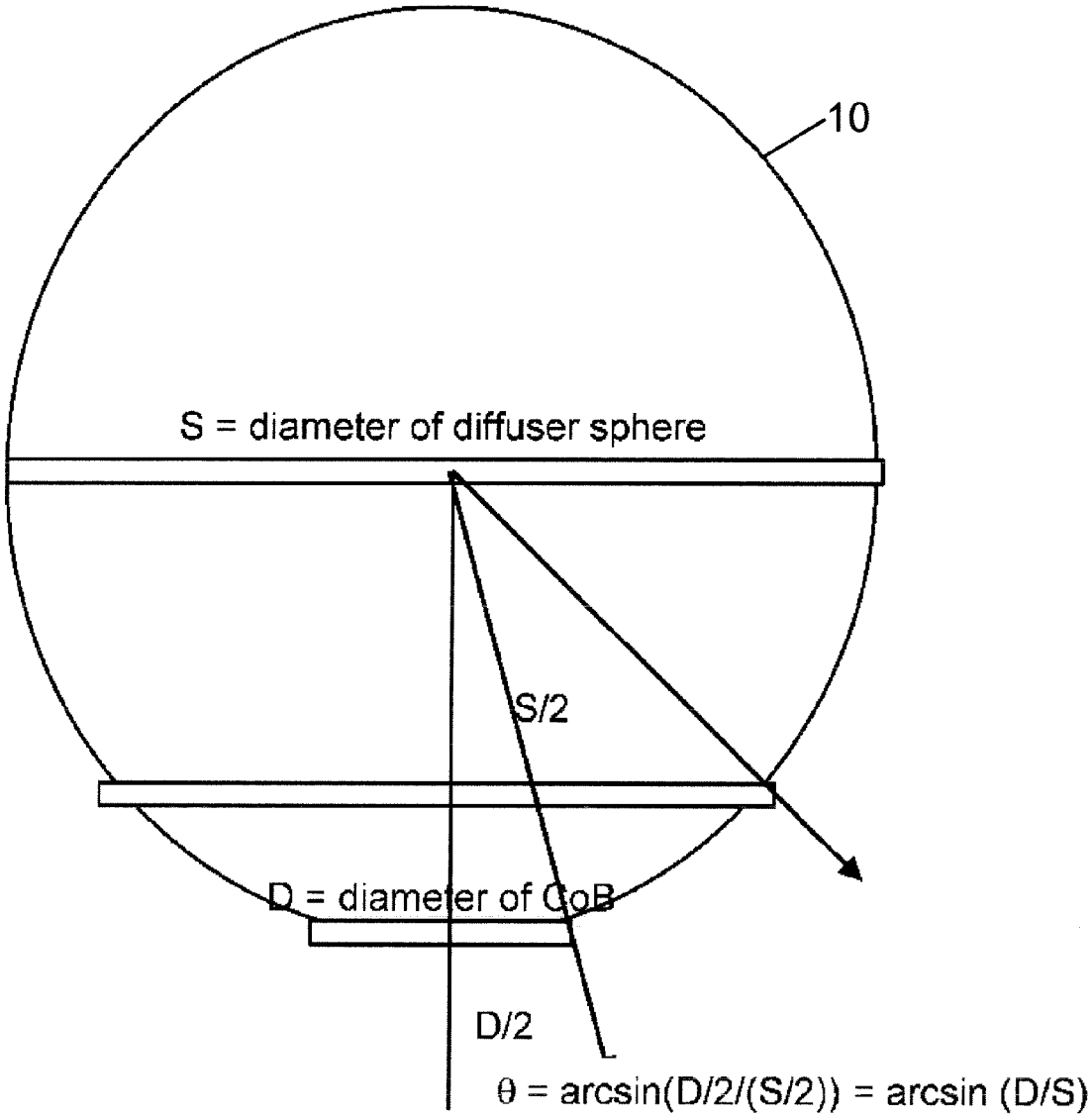
FIG. 9 illustrates impact of position of the LED-based light source relative to a spherical diffuser on the blocking angle.

With reference to FIGS. 9 and 10, the ratio of $d_D/d_L$ primarily determines the range of latitude angles over which the intensity distribution may be held constant. (Note that in FIG. 9, the symbol "D" denotes the dimension $d_L$ of the planar LED-based Lambertian light source 8 and the symbol "S" denotes the dimension $d_D$ of the diffuser 10. In FIG. 10, the ratio $d_D/d_L$ is indicated as $D_D/D_L$). As $d_L$ increases to become comparable to $d_D$ (and hence deviates more strongly from exact tangency) the location of the LED light source should be moved away from the south pole of the spherical diffuser toward the equator (that is, the plane defined by $\theta=90°$) and the range over which the intensity distribution is uniform is reduced from 0° to 180° to 0° to 90°. Another way of looking at this is that for perfect tangency the light source would meet with the spherical or spheroidal diffuser at a single point. For the light source 8 of finite dimension $d_L$, however, this "point" of meeting becomes a chord of length $d_L$ respective to the spherical or spheroidal diffuser 10. Thus, the length of the chord $d_L$ respective to the diameter $d_D$ of the diffuser 10 (or the inverse ratio thereof) is a measure of closeness to ideal tangency. By way of example, if $d_D/d_L<1.15$ then the maximum possible range of uniform intensity distribution is about $\theta=[0°, 120°]$; or if $d_D/d_L<1.5$ then the maximum possible range of uniform intensity distribution is about $\theta=[0°, 138°]$. In order to provide uniform intensity over the range of $\theta[0°, 150°]$, the ratio should be increased to $d_D/d_L>2.0$. Even with $d_D/d_L=2.0$, the intensity distribution is not uniform in at angles approaching 150° because the distribution is missing the contribution of light that would have been emitted from the surface of the sphere over the latitudes in the range of 150° to 180°. To provide nearly uniform intensity distribution over the range of 0° to 150°, $d_D/d_L$ should exceed 2.0 by an amount that depends on the scattering distribution function of the spherical diffuser, and that depends on the reflective properties of the lamp components that are place below the LED light engine, such as the heat spreader, the heat fins, and the electronics. In experiments actually performed for an LED replacement lamp for incandescent applications, it was found that $d_D/d_L>2.5$ is generally suitable in order to provide intensity uniformity within +/−10% of the average intensity over the range of 0° to 150°. If uniform intensity is desired only over the range of 0° to 135°, and/or a larger tolerance of +/−20% is deemed acceptable (such as for compliance with the U.S. Department of Energy proposed Energy Star specification), then $d_D/d_L>1.41$ is required from FIG. 10, and it would be preferred in a practical lamp embodiment for $d_D/d_L>1.6$.

A fifth design aspect is to minimize the impact of the base. Initially, one might expect this can be accomplished by employing a small base—however, this negatively impacts heat sinking which in turn limits light output intensity, and also can negatively impact the space available for lamp electronics. As disclosed herein, an improvement is to have the base narrow at its juncture with the lighting assembly comprising the LED light source and spherical or spheroidal diffuser (with the base at this juncture preferably having about the same cross-sectional area as the generally planar LED-based light source) and having angled sides whose angles are less than or about the same as a blocking angle $\alpha_B$ chosen based on the desired latitudinal range of omnidirectional illumination. For example, if the desired latitudinal range θ=[0°, 150°], then the blocking angle $\alpha_B$ should be no larger than about 30°, and in some such designs the blocking angle is about 25° in order to maximize the base size for accommodating heat sinking and electronics. The angled sides of the base should then have an angle of no more than about 30°, and preferably about 25° in order to provide maximal base volume for heat sinking proximate to the LED-based light source.

With returning reference to FIGS. 5 and 6, the heat sinking of the illustrated is passive, relying upon conduction of heat from the LED-based light source 36, 38 to the adjacent base 50, 52 and then radiating and convecting into the air or other surrounding ambient via the surface of the heat sink defined by the base 50, 52. The heat dissipation by convection and radiation can be enhanced by providing additional heat management devices such as a heat pump or thermo-electric cooler, or by adding active cooling, for example using fans, synthetic jets, or other means to enhance the flow of cooling air. The heat dissipation by convection and radiation can also be enhanced by increasing the surface area of the heat sink. One way to do this is to corrugate or otherwise modify the surface of the base heat sink element (which is the base 50, 52 in the embodiments of FIGS. 5 and 6). Fins or other heat dissipation elements can also be added to the base, but these may interfere with the light output if they extend outward beyond the blocking angle $\alpha_B$.

Figure 11:
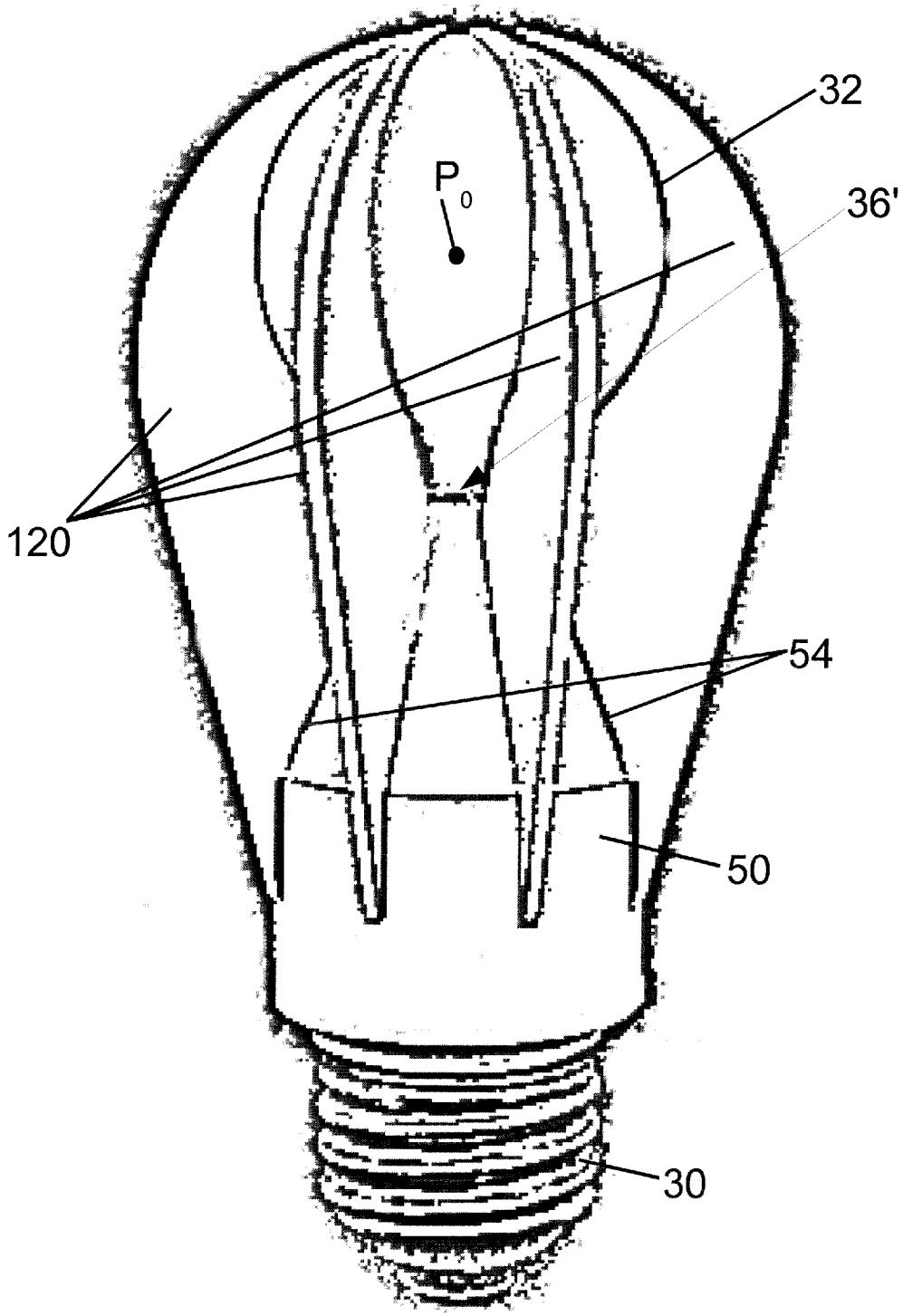
FIG. 11 shows a side perspective view of a retrofit LED-based light bulb substantially similar to the lamp of FIG. 5 but further including fins.

With reference to FIG. 11, a variant embodiment is disclosed, which comprises the embodiment of FIG. 5 with the addition of heat-dissipating fins 120 that enhance radiative and convective heat transfer from the base 50 to the air or other surrounding ambient. Said another way, the heat sink of the base 50 includes the aforementioned base heat sink element disposed within the latitudinal blocking angle $\alpha_B$ (within or coextensive with the base 50 in the illustrative embodiment of FIG. 5) and heat dissipating elements comprising illustrated fins 120 that are in thermal communication with the base heat sink element and that extend over the spheroidal diffuser 32 to further enhance heat dissipation into the ambient air by convection and radiation. That is, heat conducts from the LED chips of the LED based lighting unit 36 located at position 36' indicated in FIG. 11 to the base heat sink element and conductively spreads to the heat-dissipating fins 120 where the heat is transferred to the ambient by convection and/or radiation. The fins 120 of the lamp of FIG. 11 extend latitudinally almost to θ=0°, and hence the fins 120 extend well beyond the extent of the blocking angle $\alpha_B$. However, the fins 120 have substantially limited extent in the longitudinal (ϕ) direction; accordingly, the fins 120 do not significantly impact the omnidirectional illumination distribution generated by the lamp of FIG. 11. In other words, each fin lies substantially in a plane of constant longitude ϕ and hence does not substantially adversely impact the omnidirectional nature of the illumination distribution. More generally, so long as the heat-dissipating elements extend outward and are oriented transverse to the surface of the spherical or spheroidal diffuser, they do not substantially adversely impact the omnidirectional nature of the illumination distribution. The fins 120 are also shaped to comport with the desired form (that is, the outward shape) of an "A"-type incandescent light bulb. Such outward shaping is optional, but can be advantageous as consumers are familiar with the conventional "A"-type incandescent light bulb. The improved heat sinking provided by the fins 120 enables further reduction in the size of the planar LED-based light source, which in turn enables design to further enhance the omnidirectionality of the output light intensity distribution.

Figure 12:
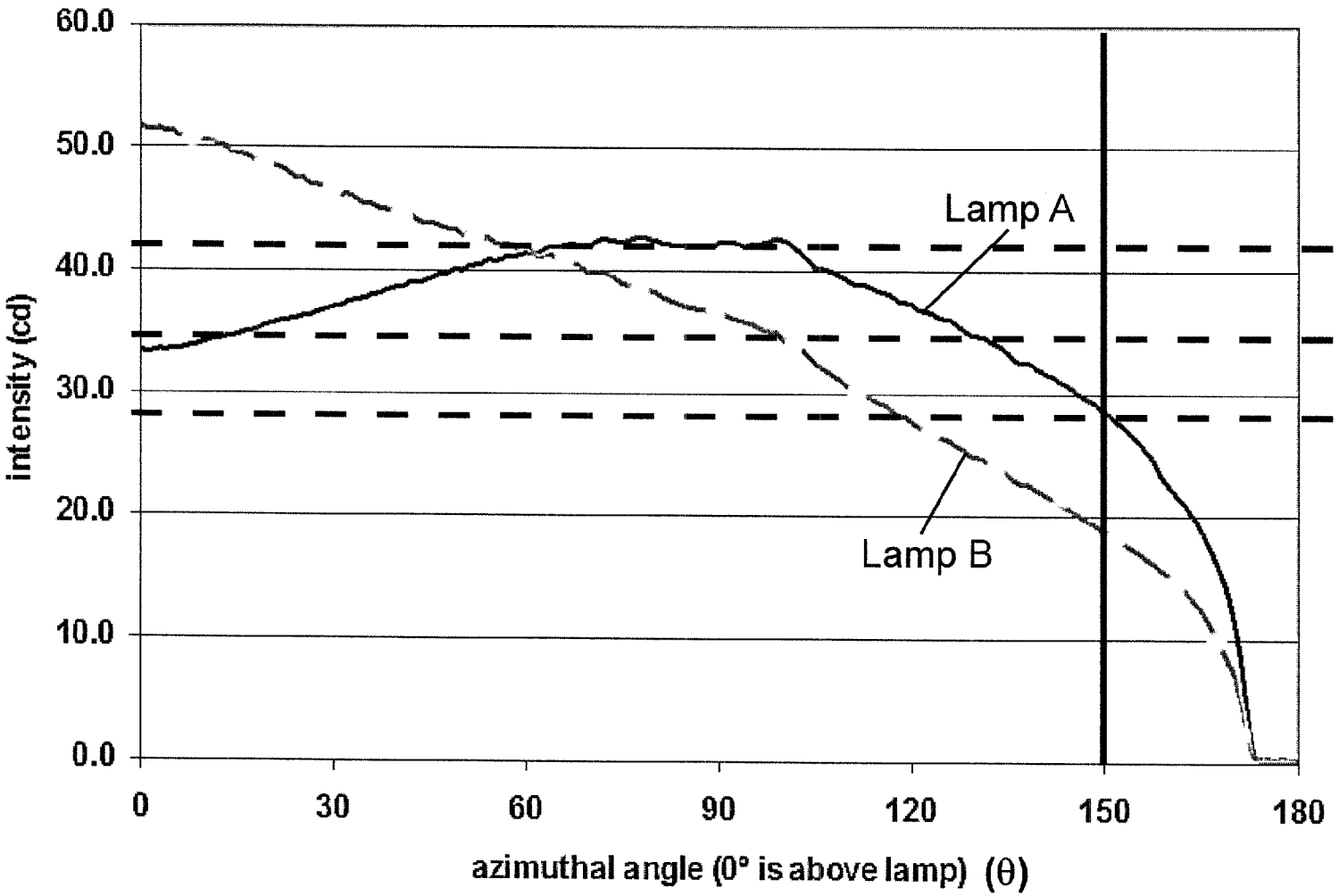
FIG. 12 plots intensity versus latitude for two actually constructed embodiments of the retrofit LED-based light bulb of FIG. 11.

With reference to FIG. 12, embodiments of the retrofit LED-based lamp shown in FIG. 11, including six fins 120, were actually constructed and their longitudinal intensity distribution measured. The actually-constructed retrofit LED-based lamps were constructed in accordance with the A19 lamp standard. The blocking angle $\alpha_B$ was 23°. The fins 120 were 1.5 mm thick and aligned to lie within a constant longitude (constant ϕ) plane as shown in FIG. 11. One embodiment (Lamp A) employed a G12 enamel lamp globe (available from General Electric Company, New York, USA) as the diffuser, whereas a second embodiment (Lamp B) employed a 40 mm plastic sandblasted sphere as the diffuser. Both lamps had the Edison base connector 30 as shown in FIG. 11. The far-field output intensity measured as a function of latitude respective to the far-field point light source location $P_0$ defined by the omnidirectional light assembly 32, 36 is plotted in FIG. 12, using a solid line for Lamp A and a dashed line for Lamp B. For Lamp A which used the enamel lamp globe as the diffuser, the intensity in the latitude span θ=[0,150°] was measured to be 35±7 cd which corresponds to uniformity within a ±20% variation, with even better uniformity for the latitude span θ=[0,135°]. The azimuthal (ϕ) was also good, with about ±15% intensity variation, so that omnidirectional illumination over the latitude span θ=[0,150°] was achieved.

On the other hand, Lamp B shows substantially inferior uniformity over the latitude span θ=[0,150°]. This is attributable to the sandblasted plastic providing inadequate light diffusion. In other words, with brief reference back to FIG. 4, the light emanating from each incident ray was not itself a Lambertian distribution as shown in FIG. 4 for the case of Lamp B, but rather had a strong bias toward continuing in the direction of the incident ray. This produces a relatively higher fraction of light in the forward θ=0° direction as indicated in FIG. 12 for Lamp B. Said another way, the inadequate diffusion provided by the sandblasted plastic of Lamp B failed to remove the strong forward illumination bias of the source light 36 in the case of Lamp B.

The illustrated fins 120 or other heat dissipating elements are readily incorporated into other unitary LED lamps, such as the LED replacement lamp of FIG. 6. The use of such fins facilitates making the connection of the base with the lighting assembly (LED-based light source and spherical or spheroidal diffuser) small, which in turn facilitates a large $d_D/d_L$ ratio which further promotes omnidirectionality over a large span of latitude angles such as the latitude span θ=[0,150°]. Further, by keeping the fins planar and lying in constant longitude (constant ϕ) planes, the impact of the fins on longitudinal intensity uniformity is small. More generally, the heat dissipating elements should extend outward away from the surface of the diffuser and be oriented transverse to the diffuser surface.

To obtain a higher light output intensity, a substantial number of higher-power LED devices are preferable. This, however, conflicts with the desire to keep the ratio of $d_D/d_L$ large so as to provide a large range of latitude angles over which the intensity distribution may be held constant, because more LED devices tends to increase the LED-based light source cross-sectional dimension $d_L$. Moreover, the additional heat generated by higher-power LED devices, and larger numbers of such devices, may in some specific embodiments be too large to accommodate using passive heat sinking.

A linear lamp embodiment is next described with reference back to the spherical embodiment of FIGS. 2-4. This spherical embodiment can be modified to be a straight linear lamp by removing the rotational symmetry about the north) (θ=0°) axis. In this linear embodiment, FIG. 4 can be viewed as a cross-sectional view taken along the linear axis of a linear lamp: the diffuser 10 is a cylinder in this variant embodiment whose cylinder axis is transverse to the drawing sheet, and the light source 8 is an elongated LED-based light source extending parallel with the cylinder axis of the (cylindrical) diffuser 10 and positioned tangential to the surface of the (cylindrical) diffuser 10. The Lambertian light intensity distributions illustrated in FIG. 4 are, in this linear lamp variant embodiment, Lambertian only in one-dimension, that is, Lambertian in the plane of the drawing sheet if the LEDs are spaced suitably close together. Thus, the Lambertian intensity pattern put out by the (elongate) LED-based light source 8 is suitably captured by the (cylindrical) diffuser 10 which follows the cylindrical isolux surface of the Lambertian intensity output by the (elongate) LED-based light source. To use this embodiment to provide a uniformly illuminated, isotropic cylindrical light source, the LED devices 40 should be relatively closely spaced in the direction perpendicular to the drawing, for example by an amount comparable to the diameter of the diffuser cylinder.

Figure 13:
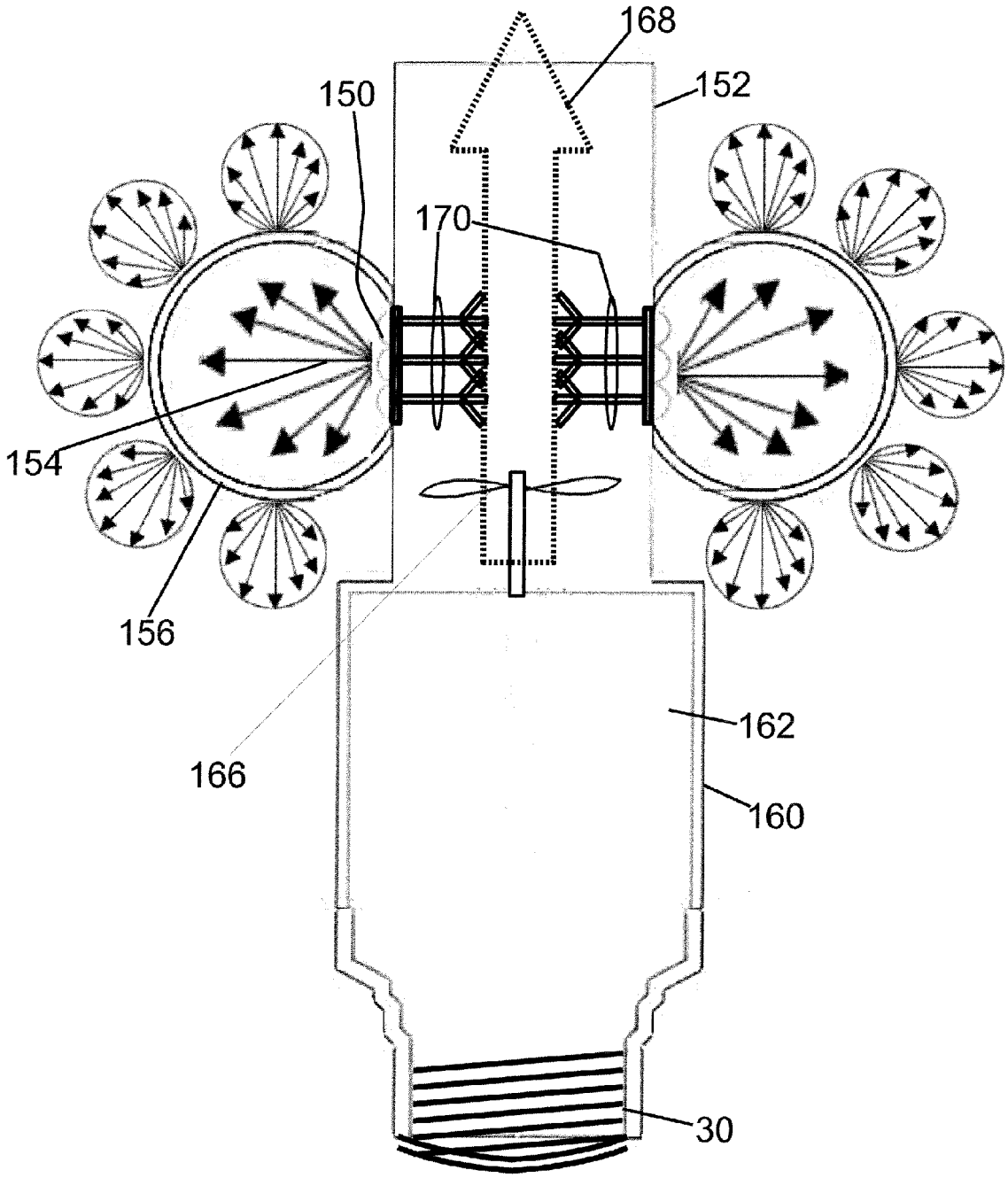
FIGS. 13 and 14 diagrammatically illustrate side and perspective side views, respectively, of a light source employing principles disclosed herein with a toroidal diffuser.
Figure 14:
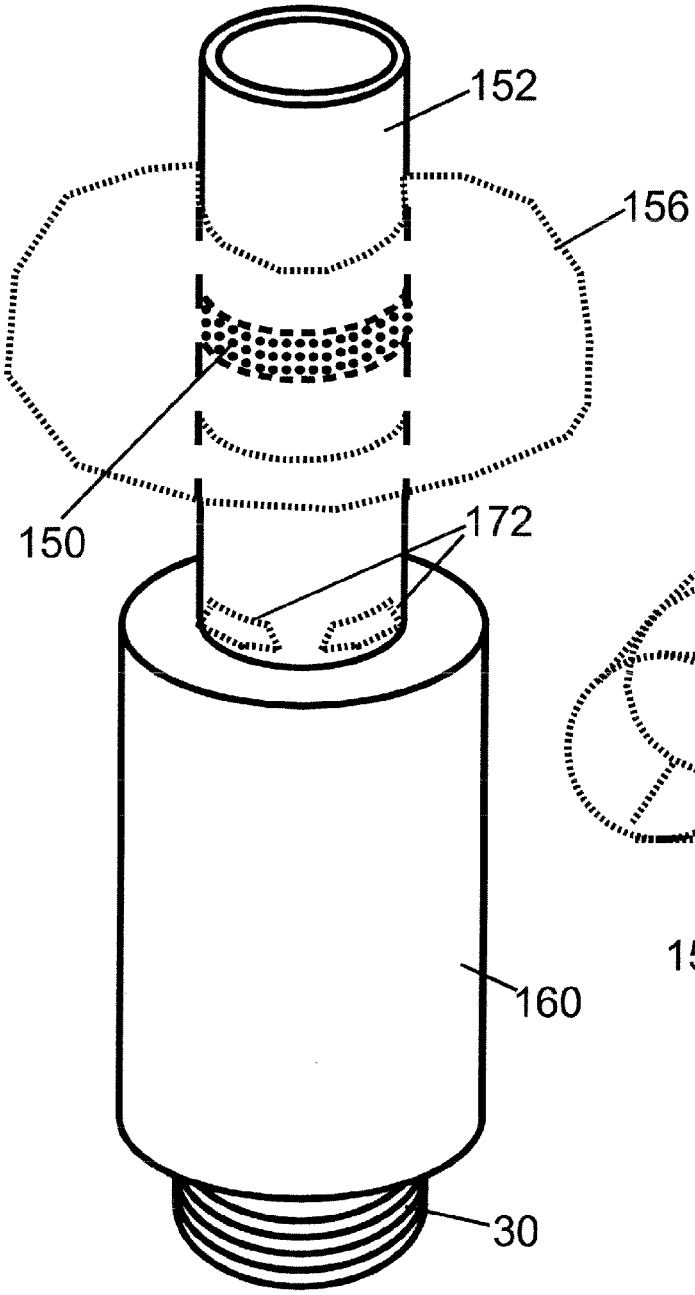

With reference to FIGS. 13 and 14, yet another embodiment is disclosed. This embodiment is not a linear lamp, but rather is an LED lamp suitable for replacing an incandescent light bulb and including the Edison base connector 30 facilitating use of the lamp as a retrofit incandescent bulb. A ring-shaped LED-based light source 150 is arranged on a cylindrical former or chimney 152 so as to emit light outward from the cylindrical former or chimney 152. This amounts to taking the linear lamp described herein and wrapping it around the cylinder of the chimney 152 in order to form a ring. Illumination intensity 154 generated by the ring-shaped light source 150 has a Lambertian distribution in any plane that is perpendicular to the annular path of the ring (as shown in FIG. 13) and therefore produces a toroidal isolux surface having a circular cross-section, if the LEDs are spaced suitably close together. A toroidal diffuser 156 having a circular cross-section (best seen in FIG. 13) is arranged to coincide with the toroidal isolux surface of the illumination intensity 154. (Note that in FIG. 14 the toroidal diffuser 156 is diagrammatically shown in phantom in order to reveal LED-based light source 150).

The ring-shaped LED-based light source 150 is arranged tangential to the inside surface of the toroidal diffuser 156 and emits its Lambertian illumination intensity into the toroidal diffuser 156. The toroidal diffuser 156 preferably has a Lambertian-diffusing surface as diagrammatically illustrated in FIG. 13, so that at each point on the surface the incident illumination 154 is diffused to produce a Lambertian intensity output pattern emanating externally from that point on the surface of the toroidal diffuser 156. As a consequence, the lighting assembly comprising the ring-shaped LED-based light source 150 and the toroidal diffuser 156 of circular path cross-section generates light that is substantially omnidirectional both latitudinally and longitudinally.

In FIGS. 13 and 14, the toroidal diffuser 156 has a circular cross-section for any point along its annular path, so that the toroidal diffuser 156 is a true torus. By analogy to FIGS. 7 and 8, if the ring-shaped LED-based light source 150 has its Lambertian intensity pattern substantially distorted in a prolate or oblate fashion, then the circular cross-section of the toroidal diffuser 156 is suitably correspondingly made prolate or oblate circular in order to coincide with an isolux surface.

Figure 14A:
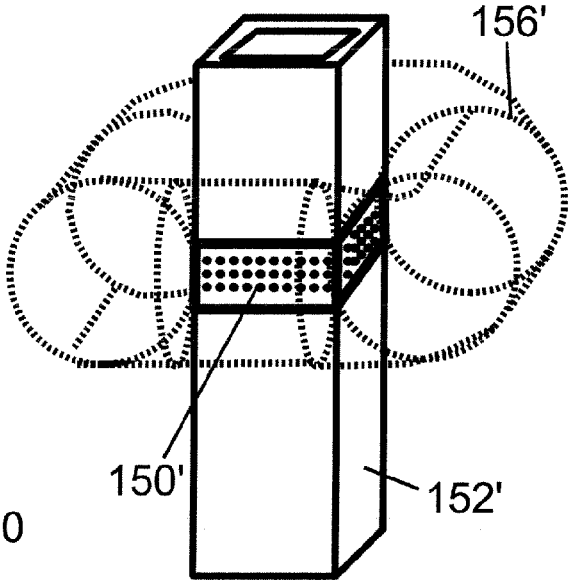
FIG. 14A depicts a variant embodiment.

The illustrated chimney 152 of FIGS. 13 and 14 has a circular cross-section, and the ring-shaped light source 150 accordingly follows a circular path. With reference to FIG. 14A, in other embodiments, the chimney 152 has a polygonal cross-section, such as a triangular, square, hexagonal or octagonal cross section (not illustrated), in which case the ring-shaped light source suitably follows a corresponding polygonal (e.g., triangular, square, hexagonal or octagonal) path that is suitably made of three adjoined planar circuit boards (for triangular), four adjoined planar circuit boards (for square), six adjoined planar circuit boards (for hexagonal) or eight adjoined planar circuit boards (for octagonal) or more generally N adjoined planar circuit boards (for an N-sided polygonal chimney cross-section). For example, FIG. 14A shows a chimney 152' having a square cross-section, and a ring-shaped light source 150' following a square path that is made of four circuit boards adjoined at 90° angles to form a square ring conforming with the rectangular cross-section of the chimney 152'. A corresponding toroidal diffuser 156' (again shown diagrammatically in phantom to reveal light source 150') is also approximately four-sided, but includes rounded transitions between adjoining sides of the four-cited toroid to facilitate manufacturing and smooth light output.

With returning reference to FIGS. 13 and 14, the lamp includes a base 160 that includes or supports the chimney 152 at one end and the Edison base connector 30 at the opposite end. As shown in the sectional view of FIG. 13, the base 160 contains electronics 162 including electronics for energizing the ring-shaped LED-based light source 150 to emit the illumination 154. As further shown in the sectional view of FIG. 13, the chimney 152 is hollow and contains a heat sink embodied as a coolant circulating fan 166 disposed inside the chimney 152. The electronics 162 also drive the coolant circulating fan 166. The fan 166 drives circulating air 168 through the chimney 152 and hence in close proximity to the ring-shaped LED-based light source 150 to cool the ring-shaped light source 150. Optionally, heat-dissipating elements 170 such as fins, pins, or so forth, extend from the ring-shaped LED-based light source 150 into the interior of the hollow chimney 152 to further facilitate the active cooling of the light source. Optionally, the chimney includes air inlets 172 (see FIG. 14) to facilitate the flow of circulating air 168.

The active heat sinking provided by the coolant fan 166 can optionally be replaced by passive cooling, for example by making the chimney of metal or another thermally conductive material, and optionally adding fins, pins, slots or other features to increase its surface area. In other contemplated embodiments, the chimney is replaced by a similarly sized heat pipe having a "cool" end disposed in a metal slug contained in the base 160. Conversely, in the embodiments of FIGS. 5 and 6 and elsewhere, the depicted passive heat sinking is optionally replaced by active heat sinking using a fan or so forth. Again, it is contemplated for the base heat sink element in these embodiments to be an active heat sink element such as a cooling fan, or another type of heat sink element such as a heat pipe.

The lamp depicted in FIGS. 13 and 14 is a unitary LED replacement lamp installable in a lighting socket (not shown) by connecting the base connector 30 with the lighting socket. The unitary LED replacement lamp of FIGS. 13 and 14 is a self-contained omnidirectional LED replacement lamp that does not rely on the socket for heat sinking, and can be driven by 110V or 220V a.c., or 12V or 24V or other voltage d.c. supplied from a lamp socket via the Edison base connector 30.

To achieve omnidirectional illumination over a large latitudinal span, such as over the latitude span $\theta=[0°, 150°]$, it is advantageous for the base 160 to be relatively narrow, such as in the case of the cylindrical base 160 illustrated in FIGS. 13 and 14. The active heat sinking via the fan 166 and hollow chimney 152 facilitates making the base 160 relatively narrow while still providing adequate heat dissipation. Moreover, FIG. 13 illustrates that the toroidal diffuser 156 extends outwardly in the plane transverse to the axis of the cylindrical chimney 152, and this further promotes illumination into larger angles, e.g. angles approaching $\theta=180°$.

The LED replacement lamp of FIGS. 13 and 14 (with optional modifications such as that illustrated in FIG. 14A) is particularly well-suited for retrofitting higher-wattage incandescent bulbs, such as incandescent bulbs in the 60 W to 100 W or higher range. Operation of the active cooling fan 166 is expected to use about one to a few watts or less, which is negligible for these higher-wattage lamps, while the active heat sinking is capable of heat transfer and dissipation at levels of tens of watts so as to enable use of high-power LED devices operating with driving currents in the ampere to several ampere range. The cooling of the lamp of FIGS. 13 and 14 does not rely predominantly upon conduction of heat into the lamp socket via the Edison base connector 30, and so the LED replacement lamp of FIGS. 13 and 14 can be used in any standard threaded light socket without concern about thermal loading of the socket or adjacent hardware. The toroidal arrangement of the light assembly also facilitates using a higher number of LEDs by spreading the LEDs out along the ring-shaped path of the ring-shaped light source 150.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A light emitting apparatus comprising:

an LED-based light source;

a spherical, spheroidal, or toroidal diffuser generating a light intensity distribution output responsive to illumination inside the diffuser; and a base including a base connector;

the LED-based light source, the diffuser, and the base being secured together as a unitary LED lamp installable in a lighting socket by connecting the base connector with the lighting socket;

the diffuser being shaped and arranged respective to the LED-based light source in the unitary LED lamp to conform with an isolux surface of the LED-based light source such that an entire inside surface of the diffuser includes a flux of the same value at any point; and the base being operatively connected with the LED-based light source in the unitary LED lamp to electrically power the LED-based light source using electrical power received at the base connector.

2. The light emitting apparatus as set forth in claim 1, wherein the spherical, spheroidal, or toroidal diffuser generates a Lambertian light intensity distribution output at any point on the diffuser surface responsive to illumination inside the diffuser.

3. The light emitting apparatus as set forth in claim 1, wherein the diffuser is a spherical or spheroidal diffuser.

4. The light emitting apparatus as set forth in claim 3, wherein the conformance of the spherical or spheroidal diffuser with an isolux surface of the LED-based light source is effective for the spherical or spheroidal diffuser to generate illumination with uniformity variation of ±30% or less over an omnidirectional illumination latitudinal range spanning at least $\theta=[0°, 120°]$ responsive to illumination inside the spherical or spheroidal diffuser by the LED-based light source.

5. The light emitting apparatus as set forth in claim 4, wherein the base is arranged outside of the omnidirectional illumination latitudinal range in the unitary LED lamp.

6. The light emitting apparatus as set forth in claim 4, wherein the base has a relatively smaller size proximate to the diffuser and a relatively larger size distal from the diffuser.

7. The light emitting apparatus as set forth in claim 1, wherein the LED-based light source is ring-shaped and the diffuser is a toroidal diffuser.

8. The light emitting apparatus as set forth in claim 7, wherein the base includes a base portion on which the ring-shaped LED-based light source is disposed.

9. The light emitting apparatus as set forth in claim 8, wherein the base portion is a hollow chimney containing a heat sink.

10. The light emitting apparatus as set forth in claim 9, wherein the heat sink comprises a cooling fan synthetic jet, or other active cooling element.

11. The light emitting apparatus as set forth in claim 8, wherein the base portion has a polygonal cross section with N sides where N is an integer greater than or equal to three and the ring-shaped LED-based light source comprises N adjoined planar circuit boards forming the ring shape.

12. The light emitting apparatus as set forth in claim 1, further comprising:

a heat sink including a base heat sink element disposed in the base.

13. The light emitting apparatus as set forth in claim 12, wherein the heat sink further comprises:

flat planar, curved planar, or linear heat dissipating elements disposed on and extending away from the spherical or spheroidal diffuser.

14. A light emitting apparatus, comprising:

a light assembly including an LED-based light source optically coupled with and arranged tangential to a light emitting portion of a spherical or spheroidal diffuser; and a base including a base connector, the base configured to electrically power the LED-based light source using electrical power received at the base connector; and the light assembly and base being secured together as a unitary LED lamp installable in a lighting socket by connecting the base connected with the lighting socket;

the diffuser being shaped and arranged respective to the LED-based light source in the unitary LED lamp to conform with an isolux surface of the LED-based light source such that an entire inside surface of the diffuser includes a flux of the same value at any point.

15. The light emitting apparatus as set forth in claim 14, wherein the base connector receives electrical power of at least 100 volts a.c., and the base further comprises:

an electronic driver configured to convert the electrical power of at least 100 volts a.c. received at the base connector to lower voltage d.c. power for electrically driving the LED-based light source.

16. The light emitting apparatus as set forth in claim 14, wherein the light assembly generates illumination with uniformity variation of ±30% or less over a latitudinal range θ=[0°,X] where latitude X≥120° and the base does not extend into the latitudinal range θ=[0°,X].

17. The light emitting apparatus as set forth in claim 16, wherein the base has sides lying along the latitude X.

18. The light emitting apparatus as set forth in claim 16, wherein the light assembly generates illumination with uniformity variation of ±20% or less over the latitudinal range θ=[0°,X].

19. The light emitting apparatus as set forth in claim 16, wherein the light assembly generates illumination with uniformity variation of ±10% or less over the latitudinal range θ=[0°,X].

20. The light emitting apparatus as set forth in claim 14, wherein the light assembly generates illumination with uniformity variation of ±30% or less over at least a latitudinal range θ=[0°,135°] and the base does not extend into the latitudinal range θ=[0°,135°].

21. The light emitting apparatus as set forth in claim 14, wherein the light assembly generates illumination with uniformity variation of ±30% or less over at least a latitudinal range θ=[0°,150°] and the base does not extend into the latitudinal range θ=[0°,150°].

22. The light emitting apparatus as set forth in claim 14, wherein the LED-based light source comprises a planar light source arranged tangentially to the spherical or spheroidal diffuser.

23. The light emitting apparatus as set forth in claim 14, wherein:

the LED-based light source is of dimension $d_L$ and is arranged tangential to the spherical or spheroidal diffuser, and a ratio of the diameter or major axis or minor axis of the spherical or spheroidal diffuser to the dimension $d_L$ is greater than 1.4.

24. The light emitting apparatus as set forth in claim 23, wherein the ratio of the diameter or major axis or minor axis of the spherical or spheroidal diffuser to the dimension $d_L$ is greater than 2.0.

25. The light emitting apparatus as set forth in claim 23, wherein the ratio of the diameter or major axis or minor axis of the spherical or spheroidal diffuser to the dimension $d_L$ is greater than 2.5.

26. The light emitting apparatus as set forth in claim 14, further comprising:

a heat sink including a base heat sink element disposed in the base.

27. The light emitting apparatus as set forth in claim 26, wherein the heat sink further comprises:

heat-dissipating elements in thermal communication with the base heat sink element and extending outward from and oriented transverse to the surface of the spherical or spheroidal diffuser.

28. The light emitting apparatus as set forth in claim 27, wherein the heat dissipating elements comprise fins oriented in planes of constant longitude.

29. The light emitting apparatus as set forth in claim 14, wherein the base connector comprises a threaded Edison base connector.

30. The light emitting apparatus as set forth in claim 14, wherein the base lies within a far field latitudinal blocking angle of 60° or less and has angled sides with angles that are about the same as the blocking angle.

31. The light emitting apparatus as set forth in claim 14, wherein the base lies within a far field latitudinal blocking angle of 45° or less and has angled sides with angles that are about the same as the blocking angle.

32. The light emitting apparatus as set forth in claim 14, wherein the spherical or spheroidal diffuser generates a Lambertian light intensity distribution output at any point on the diffuser surface responsive to illumination by the LED-based light source.

33. The light emitting apparatus as set forth in claim 32, wherein the spherical or spheroidal diffuser conforms with an isolux surface of the LED-based light source with conformance effective for the light assembly to generate illumination with uniformity variation of ±30% or less over a latitudinal range of at least θ=[0°, 120°].

34. The light emitting apparatus as set forth in claim 33, wherein the spherical or spheroidal diffuser conforms with a spherical or spheroidal isolux surface of the LED-based light source with conformance effective for the light assembly to generate illumination with uniformity variation of ±20% or less over a latitudinal range of at least θ=[0°, 150°].

35. The light emitting apparatus as set forth in claim 32, wherein:

the LED-based light source emits an intensity distribution selected from a group consisting of (i) a Lambertian distribution, (ii) a prolate-distorted Lambertian distribution, and (iii) an oblate-distorted Lambertian distribution, and the spherical or spheroidal diffuser has a shape substantially matching the intensity distribution emitted by the LED-based light source.

36. The light emitting apparatus as set forth in claim 35, wherein the shape of the spherical or spheroidal diffuser further accommodates an effect on the intensity distribution of reflection by a surface of the base.

* * * * *